US010825375B1

(12) United States Patent
Lin et al.

(10) Patent No.: US 10,825,375 B1
(45) Date of Patent: Nov. 3, 2020

(54) METHOD AND SYSTEM FOR DETERMINING GRAYSCALE MAPPING CORRELATION IN DISPLAY PANEL

(71) Applicant: SHENZHEN YUNYINGGU TECHNOLOGY CO., LTD., Shenzhen (CN)

(72) Inventors: Yaoming Lin, Shanghai (CN); Guoqiang Mei, Shanghai (CN); Yongwen Jiang, Shanghai (CN); Wenguang Yang, Shanghai (CN); Yan Lin, Shanghai (CN); Zhenqiang Ma, Shanghai (CN); Yuan Zi, Shanghai (CN)

(73) Assignee: SHENZHEN YUNYINGGU TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/709,302

(22) Filed: Dec. 10, 2019

Related U.S. Application Data

(63) Continuation of application No. PCT/CN2019/083087, filed on Apr. 17, 2019.

(51) Int. Cl.
*G09G 3/20* (2006.01)
*G09G 3/36* (2006.01)
*G09G 3/3208* (2016.01)

(52) U.S. Cl.
CPC ..... *G09G 3/2007* (2013.01); *G09G 3/3208* (2013.01); *G09G 3/36* (2013.01); *G09G 2320/0693* (2013.01); *G09G 2340/06* (2013.01); *G09G 2360/16* (2013.01)

(58) Field of Classification Search
None
See application file for complete search history.

(56) References Cited

U.S. PATENT DOCUMENTS

2009/0002785 A1* 1/2009 Marcu ..... H04N 1/603 358/525
2010/0259555 A1* 10/2010 Hibi ..... G09G 3/3611 345/601
2014/0267785 A1* 9/2014 Chen ..... G09G 5/02 348/189
2017/0249890 A1* 8/2017 Yoo ..... G09G 3/2074
2020/0098333 A1* 3/2020 Marcu ..... G09G 5/06

* cited by examiner

*Primary Examiner* — Sepehr Azari
(74) *Attorney, Agent, or Firm* — Bayes PLLC

(57) ABSTRACT

The present disclosure provides a method for determining a grayscale mapping correlation in a display panel. The method includes the following operations. First, a target first luminance value of the display panel is determined. A first set of start pixel values of a first attribute of a first grayscale value is determined based on the first grayscale value and the target first luminance value of the display panel. A first set of mapped pixel values of the first attribute mapped to the first grayscale value, and a first mapped luminance value are then determined based on the first set of start pixel values of the first attribute and a set of first target values of a second attribute. The set of first target values of the second attribute include a plurality of target chrominance values and the target first luminance value.

20 Claims, 12 Drawing Sheets

500

MAPPED PIXEL VALUES OF EACH COLOR

| GRAYSCALE VALUE | R | G | B |
|---|---|---|---|
| 0 | 0 | 0 | 0 |
| 4 | 43 | 46 | 30 |
| 8 | 76 | 81 | 45 |
| 12 | 104 | 110 | 64 |
| ... | ... | ... | ... |
| ... | ... | ... | ... |
| 4095 | 4095 | 4095 | 4095 |

FIG. 5

METHOD AND SYSTEM FOR DETERMINING GRAYSCALE MAPPING CORRELATION IN DISPLAY PANEL

CROSS REFERENCE TO RELATED APPLICATION

This application is continuation of International Application No. PCT/CN2019/083087, filed on Apr. 17, 2019, entitled "METHOD AND SYSTEM FOR DETERMINING GRAYSCALE MAPPING CORRELATION IN DISPLAY PANEL," which is hereby incorporated by reference in its entirety.

BACKGROUND

The disclosure relates generally to display technologies, and more particularly, to method and system for determining grayscale mapping correlation in a display panel.

In display technology, differences in the manufacturing and calibration can result in differences of product performances. For example, these differences may exist in the backlight performance of liquid crystal display (LCD) panels, light-emitting performance of organic light-emitting diode (OLED) display panels, and performance of thin-film transistors (TFTs), resulting differences in the maximum brightness level, variation in brightness levels and/or or chrominance values. Meanwhile, different geographic locations, devices, and applications may require different display standards for display panels. For example, display standards on the display panels in Asia and Europe may require different color temperature ranges. To satisfy different display standards, display panels are often calibrated to meet desired display standards.

SUMMARY

The disclosure relates generally to display technologies, and more particularly, to method and system for determining grayscale mapping correlation in a display panel.

In one example, a method for determining a grayscale mapping correlation in a display panel is provided. The method includes the following operations. First, a target first luminance value of the display panel is determined. Of a first grayscale value, a first set of start pixel values of a first attribute is determined based on the first grayscale value and the target first luminance value of the display panel. Mapped to the first grayscale value, a first set of mapped pixel values of the first attribute and a first mapped luminance value are determined based on the first set of start pixel values of the first attribute and a set of first target values of a second attribute. The set of first target values of the second attribute include a plurality of target chrominance values and the target first luminance value. Then, of a second grayscale value, a second set of start pixel values of the first attribute is determined based on the first set of mapped pixel values of the first attribute and a target luminance-grayscale correlation. The second grayscale value is less than the first grayscale value. A target second luminance value of the display panel is determined based on the second grayscale value, the first mapped luminance value and the target luminance-grayscale correlation. Further, mapped to the second grayscale value, a second set of mapped pixel values of the first attribute is determined based on the second start set of start pixel values of the first attribute, and a set of second target values having the plurality of target chrominance values and the target second luminance value.

In another example, a method for determining a grayscale mapping correlation in a display panel is provided. The method includes the following operations. A target luminance-grayscale mapping correlation and a set of target chrominance values of the display panel are first determined. A target first luminance value of the display panel mapped to a first grayscale value is determined. A first set of start pixel values based on the first target first luminance value is then determined. Further, a first set of mapped pixel values of the first grayscale value and a first mapped luminance value are determined based on the first set of start pixel values, the target first luminance value, and the set of target chrominance values. A target second luminance value of the display panel mapped to a second grayscale value is determined based on the second grayscale value and the first mapped luminance value. The second grayscale value is lower than the first grayscale value. Then, a second set of start pixel values is determined based on the first set of mapped pixel values, the target luminance-grayscale correlation, and the set of target chrominance values. A second set of mapped pixel values of the second grayscale value is then determined based on the second set of start pixel values, the target second luminance value, and the set of target chrominance values.

In another example, a system for determining a grayscale mapping correlation in a display panel is provided. The system includes a display, a processor and a data transmitter. The display has a plurality of pixel each having a plurality of subpixels. The processor includes a graphics pipeline configured to generate a plurality of pixel values for the plurality of subpixels in each frame and a pre-processing module. The pre-processing module is configured to determine a target first luminance value of the display panel, a first set of start pixel values of a first attribute of a first grayscale value based on the first grayscale value and the target first luminance value of the display panel, a first set of mapped pixel values of the first attribute mapped to the first grayscale value and a first mapped luminance value based on the first set of start pixel values of the first attribute and a set of first target values of a second attribute. The set of first target values of the second attribute includes a plurality of target chrominance values and the target first luminance value. The pre-processing module is also configured to determine, of a second grayscale value, a second set of start pixel values of the first attribute based on the first set of mapped pixel values of the first attribute and a target luminance-grayscale correlation. The second grayscale value is less than the first grayscale value. The pre-processing module is further configured to determine a target second luminance value of the display panel based on the second grayscale value, the first mapped luminance value and the target luminance-grayscale correlation. The pre-processing module is further configured to determine, mapped to the second grayscale value, a second set of mapped pixel values of the first attribute based on the second start set of start pixel values of the first attribute, and a set of second target values having the plurality of target chrominance values and the target second luminance value. The data transmitter is configured to transmit the plurality of pixel values from the processor to the display in the frame.

In still another example, a system for determining a grayscale mapping correlation in a display panel is provided. The system includes a display, a processor, and a data transmitter. The display has a plurality of pixel each having a plurality of subpixels. The processor includes a graphics pipeline configured to generate a plurality of pixel values for the plurality of subpixels in each frame and a pre-processing module. The pre-processing module is configured to determine a target luminance-grayscale mapping correlation and a set of target chrominance values of the display panel, a target first luminance value of the display panel mapped to a first grayscale value, a first set of start pixel values based on the first target first luminance value and a first set of mapped pixel values of the first grayscale value and a first mapped luminance value based on the first set of start pixel values, the target first luminance value, and the set of target chrominance values. The pre-processing module is also configured to determine a target second luminance value of the display panel mapped to a second grayscale value based on the second grayscale value and the first mapped luminance value. The second grayscale value is lower than the first grayscale value. The pre-processing module is also configured to determine a second set of start pixel values based on the first set of mapped pixel values, the target luminance-grayscale correlation, and the set of target chrominance values, and a second set of mapped pixel values of the second grayscale value based on the second set of start pixel values, the target second luminance value, and the set of target chrominance values. The data transmitter is configured to transmit the plurality of pixel values from the processor to the display in the frame.

BRIEF DESCRIPTION OF THE DRAWINGS

The embodiments will be more readily understood in view of the following description when accompanied by the below figures and wherein like reference numerals represent like elements, wherein:

FIG. 5 is a depiction of an example of a grayscale mapping correlation lookup table in accordance with an embodiment;

DETAILED DESCRIPTION

Figure 1:
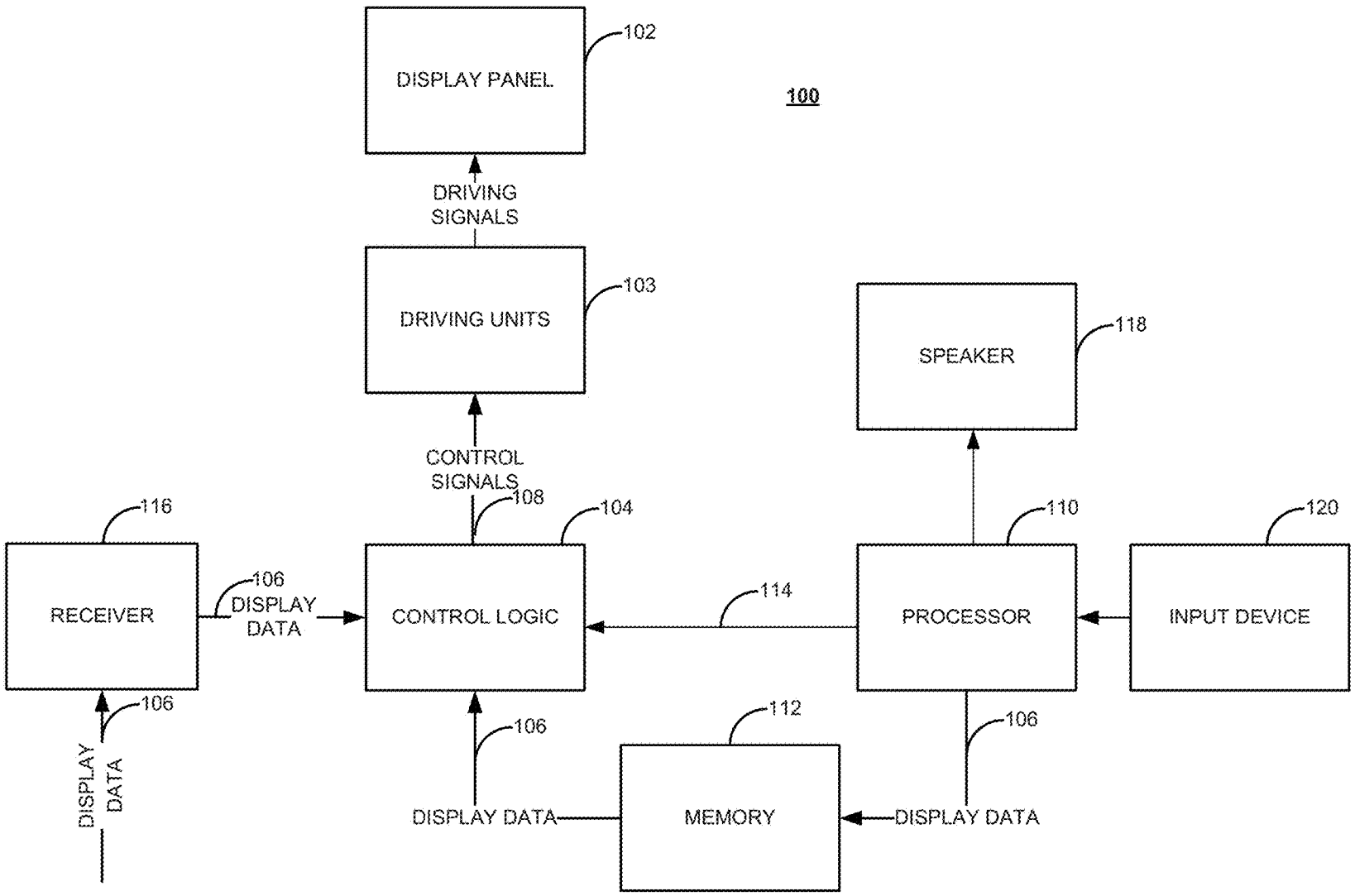
FIG. 1 is a block diagram illustrating an apparatus including a display and control logic in accordance with an embodiment.

In the following detailed description, numerous specific details are set forth by way of examples in order to provide a thorough understanding of the relevant disclosures. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

In the present disclosure, each pixel or subpixel of a display panel can be directed to assume a luminance/pixel value discretized to the standard set $[0, 1, 2, \ldots, (2^N-1)]$, where N represents the bit number and is a positive integer. A triplet of such pixels/subpixels provides the red (R), green (G), and B (blue) components that make up an arbitrary color which can be updated in each frame. Each of the pixel value corresponds to a different grayscale value. For ease of description, the grayscale value of a pixel is also discretized to a standard set $[0, 1, 2, \ldots, (2^N-1)]$. In the present disclosure, a pixel value and a grayscale value each represents the voltage applied on the pixel/subpixel. In the present disclosure, a grayscale mapping correlation lookup table (LUT) is employed to describe the mapping correlation between a grayscale value of a pixel and a set of mapped pixel values of subpixels. In the present disclosure, the display data of a pixel can the represented in the forms of different attributes. For example, display data of a pixel can be represented as (R, G, B), where R, G, and B each represents a respective pixel value of a subpixel in the pixel. In another example, the display data of a subpixel can be represented as (Y, x, y), where Y represents the luminance value, and x and y each represents a chrominance value. For illustrative purposes, the present disclosure only describes a pixel having three subpixels, each displaying a different color (e.g., R, G, B colors). It should be appreciated that the disclosed methods can be applied on pixels having any suitable number of subpixels that can separately display various colors such as 2 subpixels, 4 subpixels, 5 pixels, and so forth. The number of subpixels and the colors displayed by the subpixels should not be limited by the embodiments of the present disclosure.

In the present disclosure, a numerical space is employed to illustrate the method for determining a set of mapped pixels mapped to a grayscale value based on a target luminance value and a plurality of target chrominance values. The numerical space has a plurality of axes extending from an origin. Each of the three axes represent the grayscale value of one color displayed by the display panel. For ease of description, the numerical space has three axes, each being orthogonal to one another and representing the pixel value of a subpixel in a pixel to display a color. In some embodiments, the numerical space is an RGB space having three axes, representing the pixel values for a subpixel to display a red (R) color, a green (G) color, and a blue (B) color. A point in the RGB space can have a set of coordinates. Each component (i.e., one of the coordinates) of the set of coordinates represents the pixel value (i.e., displayed by the respective subpixel) along the respective axis. For example, a point of (R0, G0, B0) represents a pixel having pixel values of R0, G0, and B0 applied respectively on the R, G, and B subpixels. The RGB space is employed herein to, e.g., determine different sets of pixel values for the ease of description, and can be different from a standard RGB color space defined as a color space based on the RGB color model. For example, the RGB space employed herein represents the colors that can be displayed by the display panel. These colors may or may not be the same as the colors defined in a standard RGB color space.

In display technology, display panels are calibrated to have different input/output characteristics for various reasons. Common calibrations of display panels include a luminance-voltage/grayscale calibration (i.e., "Gamma calibration") and a chromaticity calibration. The luminance-voltage calibration allows the display panel to display a desired luminance at a specific voltage/grayscale value. The chromaticity calibration allows the display panel to display a desired color temperature that is unchanged at different grayscale values. These two calibrations are often separately performed, causing an undesirably long period of time and/or unsatisfactory calibration results such as inconsistent calibrated voltages/grayscale values for color temperature and luminance. The calibration of display panel needs to be improved.

As will be disclosed in detail below, among other novel features, the display system, apparatus, and method disclosed herein can allow the luminance-grayscale calibration and the chromaticity calibration to be performed in one process (e.g., at the same time). The present disclosure provides a grayscale mapping correlation look-up table (LUT) in which each grayscale value of a pixel is mapped to a set of mapped pixel values, which represents the mapped pixel values of all subpixels (e.g., R, G, B colors). The grayscale mapping correlation encompasses the calibration of luminance-grayscale value and chromaticity. By applying the mapped pixel values at a grayscale, calibration of luminance-grayscale value and chromaticity can be realized at the same time. The display panel can display images at desired luminance and color temperature. Because the luminance-grayscale calibration and the chromaticity calibration are performed in one process, the color temperature stays unchanged when the luminance or grayscale values change.

The determination of the grayscale mapping correlation starts from the determination of the actual white luminance range of the display panel, a target grayscale mapping correlation, and a plurality of target chrominance values. A spatial approximation method is employed to determine the mapped pixel value of each subpixel at a desired grayscale value. The method can start from determining the mapped pixel values of the highest grayscale value in the grayscale mapping correlation. Mapped pixel values of smaller grayscale values can be determined based on these mapped pixel values, the target grayscale mapping correlation, and the target chrominance value. The mapped pixel values of all subpixels at all grayscale values can be determined. The method can be used to calibrate any suitable types of display panels such as LCDs and OLED displays. In some embodiments, the determination of grayscale mapping correlation is computed by a processor (or an application processor (AP)), and/or a control logic (or a display driver integrated circuit (DDIC)).

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

FIG. 1 illustrates an apparatus 100 including a display 102, driving units 103, and control logic 104. The apparatus 100 may be any suitable device, for example, a television set, laptop computer, desktop computer, netbook computer, media center, handheld device (e.g., dumb or smart phone, tablet, etc.), electronic billboard, gaming console, set-top box, printer, or any other suitable device. In this example, the display 102 is operatively coupled to the control logic 104 via driving units 103 and is part of the apparatus 100, such as but not limited to, a television screen, computer monitor, dashboard, head-mounted display, or electronic billboard. The display 102 may be a LCD, OLED display, E-ink display, ELD, billboard display with incandescent lamps, or any other suitable type of display. The control logic 104 may be any suitable hardware, software, firmware, or combination thereof, configured to receive display data 106 and render the received display data 106 into control signals 108 for driving the array of subpixels of the display 102 by driving units 103. For example, subpixel rendering algorithms for various subpixel arrangements may be part of the control logic 104 or implemented by the control logic 104. The control logic 104 may include any other suitable components, including an encoder, a decoder, one or more processors, controllers (e.g., timing controller), and storage devices. Examples of the control logic 104 and methods for determining the grayscale mapping correlation in display 102 implemented by the control logic 104 or processor 110 are described in detail with reference to FIGS. 7 and 8, respectively. The apparatus 100 may also include any other suitable component such as, but not limited to, a speaker 118 and an input device 120, e.g., a mouse, keyboard, remote controller, handwriting device, camera, microphone, scanner, etc.

In one example, the apparatus 100 may be a laptop or desktop computer having a display 102. In this example, the apparatus 100 also includes a processor 110 and memory 112. The processor 110 may be, for example, a graphic processor (e.g., GPU), a general processor (e.g., APU, accelerated processing unit; GPGPU, general-purpose computing on GPU), or any other suitable processor. The memory 112 may be, for example, a discrete frame buffer or a unified memory. The processor 110 is configured to generate display data 106 in display frames and temporally store the display data 106 in the memory 112 before sending it to the control logic 104. The processor 110 may also generate other data, such as but not limited to, control instructions 114 or test signals, and provide them to the control logic 104 directly or through the memory 112. The control logic 104 then receives the display data 106 from the memory 112 or from the processor 110 directly.

In another example, the apparatus 100 may be a television set having a display 102. In this example, the apparatus 100 also includes a receiver 116, such as but not limited to, an antenna, radio frequency receiver, digital signal tuner, digital display connectors, e.g., HDMI, DVI, DisplayPort, USB, Bluetooth, WiFi receiver, or Ethernet port. The receiver 116 is configured to receive the display data 106 as an input of the apparatus 100 and provide the native or modulated display data 106 to the control logic 104.

In still another example, the apparatus 100 may be a handheld device, such as a smart phone or a tablet. In this example, the apparatus 100 includes the processor 110, memory 112, and the receiver 116. The apparatus 100 may both generate display data 106 by its processor 110 and receive display data 106 through its receiver 116. For example, the apparatus 100 may be a handheld device that works as both a portable television and a portable computing device. In any event, the apparatus 100 at least includes the display 102 with specifically designed subpixel arrangements as described below in detail and the control logic 104 for the specifically designed subpixel arrangements of the display 102.

Figure 2A:
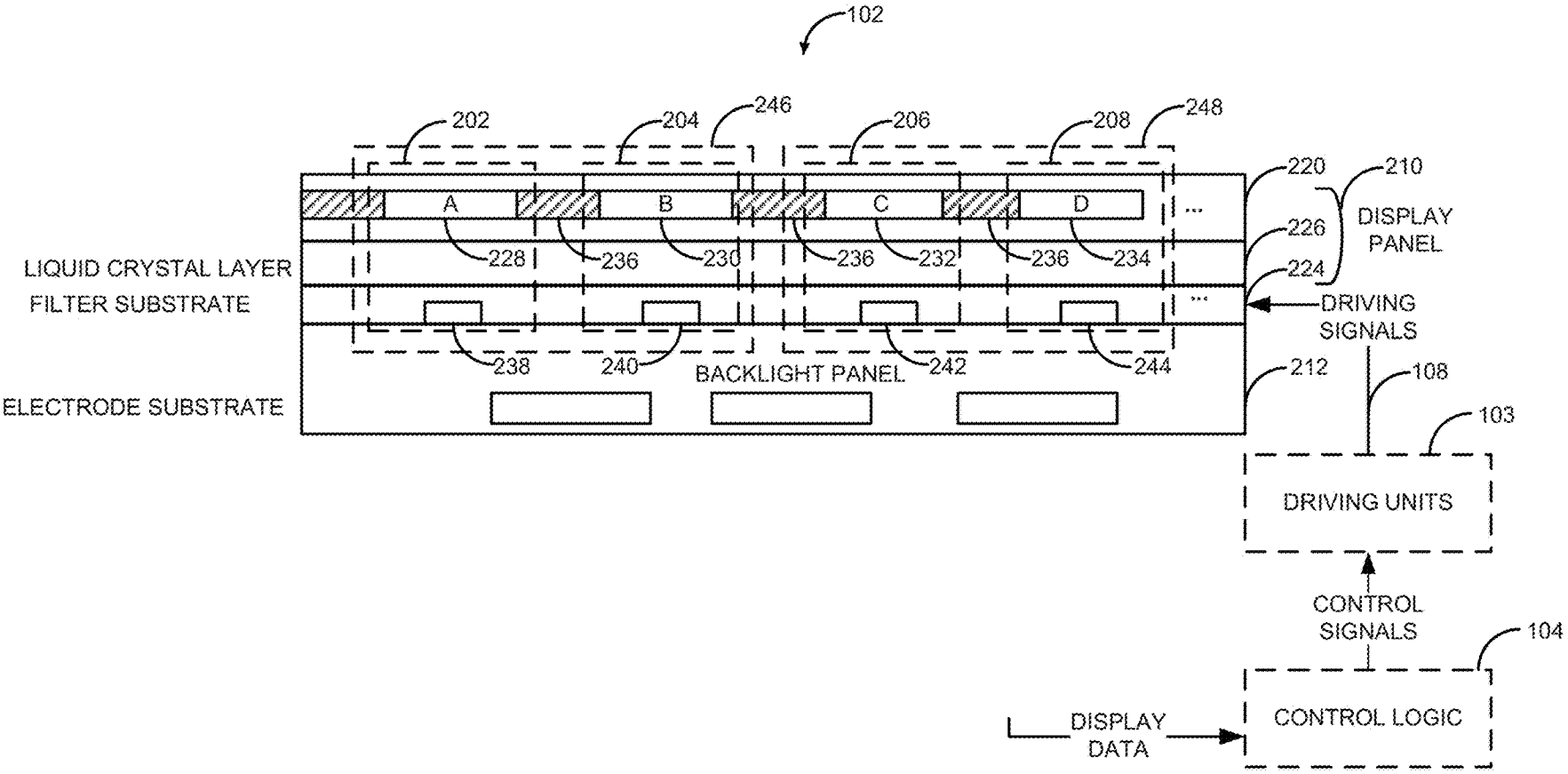
FIGS. 2A and 2B are each a side-view diagram illustrating an example of the display shown in FIG. 1 in accordance with various embodiments.

FIG. 2A illustrates one example of the display 102 including an array of subpixels 202, 204, 206, 208. The display 102 may be any suitable type of display, for example, LCDs, such as a twisted nematic (TN) LCD, in-plane switching (IPS) LCD, advanced fringe field switching (AFFS) LCD, vertical alignment (VA) LCD, advanced super view (ASV) LCD, blue phase mode LCD, passive-matrix (PM) LCD, or any other suitable display. The display 102 may include a display panel 210 and a backlight panel 212, which are operatively coupled to the control logic 104. The backlight panel 212 includes light sources for providing lights to the display panel 210, such as but not limited to, incandescent light bulbs, LEDs, EL panel, cold cathode fluorescent lamps (CCFLs), and hot cathode fluorescent lamps (HCFLs), to name a few.

The display panel 210 may be, for example, a TN panel, an IPS panel, an AFFS panel, a VA panel, an ASV panel, or any other suitable display panel. In this example, the display panel 210 includes a filter substrate 220, an electrode substrate 224, and a liquid crystal layer 226 disposed between the filter substrate 220 and the electrode substrate 224. As shown in FIG. 2, the filter substrate 220 includes a plurality of filters 228, 230, 232, 234 corresponding to the plurality of subpixels 202, 204, 206, 208, respectively. A, B, C, and D in FIG. 2A denote four different types of filters, such as but not limited to, red, green, blue, yellow, cyan, magenta, or white filter. The filter substrate 220 may also include a black matrix 236 disposed between the filters 228, 230, 232, 234 as shown in FIG. 2A. The black matrix 236, as the borders of the subpixels 202, 204, 206, 208, is used for blocking the lights coming out from the parts outside the filters 228, 230, 232, 234. In this example, the electrode substrate 224 includes a plurality of electrodes 238, 240, 242, 244 with switching elements, such as thin film transistors (TFTs), corresponding to the plurality of filters 228, 230, 232, 234 of the plurality of subpixels 202, 204, 206, 208, respectively. The electrodes 238, 240, 242, 244 with the switching elements may be individually addressed by the control signals 108 from the control logic 104 and are configured to drive the corresponding subpixels 202, 204, 206, 208 by controlling the light passing through the respective filters 228, 230, 232, 234 according to the control signals 108. The display panel 210 may include any other suitable component, such as one or more glass substrates, polarization layers, or a touch panel, as known in the art.

As shown in FIG. 2A, each of the plurality of subpixels 202, 204, 206, 208 is constituted by at least a filter, a corresponding electrode, and the liquid crystal region between the corresponding filter and electrode. The filters 228, 230, 232, 234 may be formed of a resin film in which dyes or pigments having the desired color are contained. Depending on the characteristics (e.g., color, thickness, etc.) of the respective filter, a subpixel may present a distinct color and brightness. In this example, two adjacent subpixels may constitute one pixel for display. For example, the subpixels A 202 and B 204 may constitute a pixel 246, and the subpixels C 206 and D 208 may constitute another pixel 248. Here, since the display data 106 is usually programmed at the pixel level, the two subpixels of each pixel or the multiple subpixels of several adjacent pixels may be addressed collectively by subpixel rendering to present the brightness and color of each pixel, as designated in the display data 106, with the help of subpixel rendering. However, it is understood that, in other examples, the display data 106 may be programmed at the subpixel level such that the display data 106 can directly address individual subpixel without the need of subpixel rendering. Because it usually requires three primary colors (red, green, and blue) to present a full color, specifically designed subpixel arrangements are provided below in detail for the display 102 to achieve an appropriate apparent color resolution.

Figure 2B:
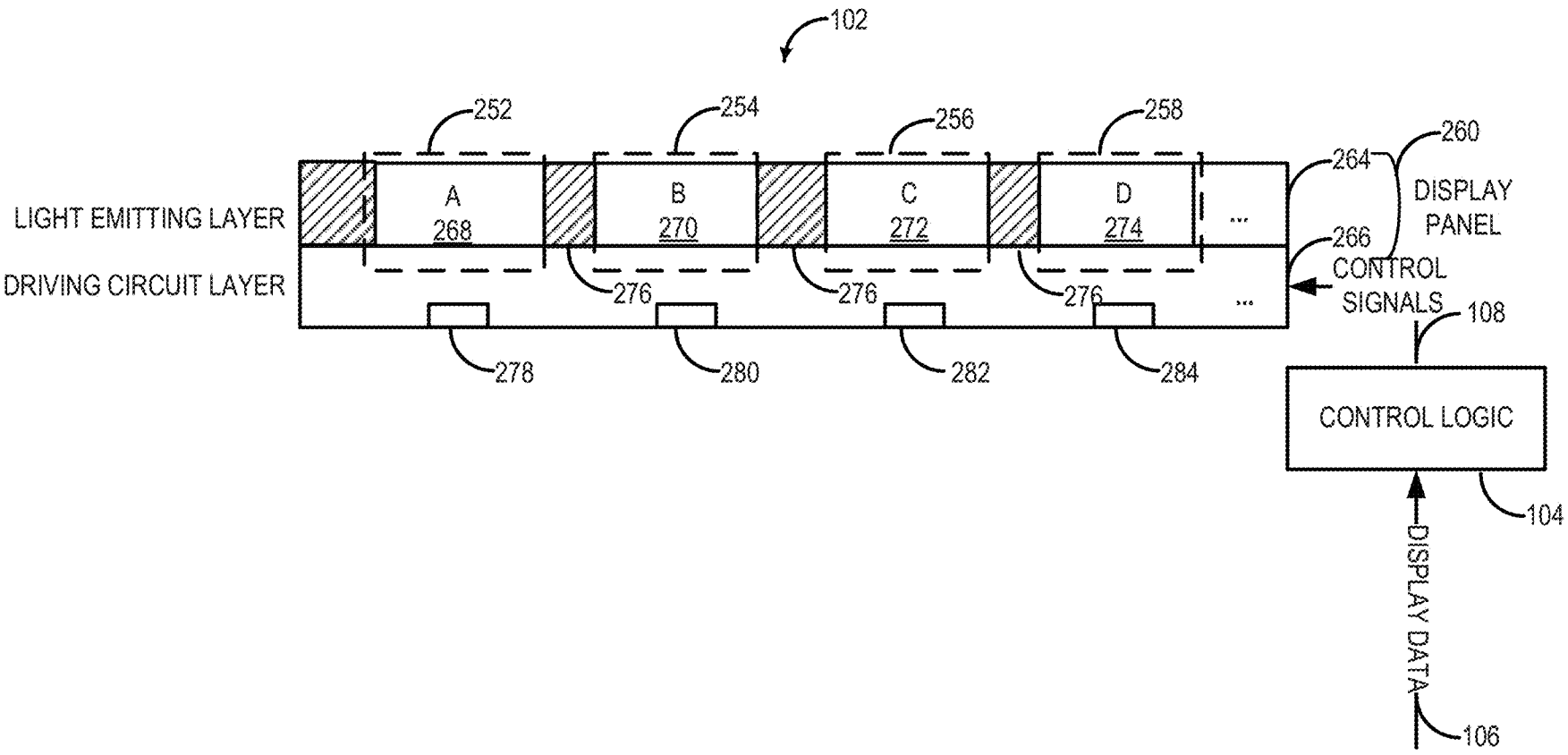

FIG. 2B is a side-view diagram illustrating one example of display 102 including subpixels 252, 254, 256, and 258. Display 102 may be any suitable type of display, for example, OLED displays, such as an active-matrix OLED (AMOLED) display, or any other suitable display. Display 102 may include a display panel 260 operatively coupled to control logic 104. The example shown in FIG. 2B illustrates a side-by-side (a.k.a. lateral emitter) OLED color patterning architecture in which one color of light-emitting material is deposited through a metal shadow mask while the other color areas are blocked by the mask.

In this embodiment, display panel 260 includes light emitting layer 264 and a driving circuit layer 266. As shown in FIG. 2B, light emitting layer 264 includes a plurality of light emitting elements (e.g., OLEDs) 268, 270, 272, and 274, corresponding to a plurality of subpixels 252, 254, 256, and 258, respectively. A, B, C, and D in FIG. 2B denote OLEDs in different colors, such as but not limited to, red, green, blue, yellow, cyan, magenta, or white. Light emitting layer 264 also includes a black array 276 disposed between OLEDs 268, 270, 272, and 274, as shown in FIG. 2B. Black array 276, as the borders of subpixels 252, 254, 256, and 258, is used for blocking light coming out from the parts outside OLEDs 268, 270, 272, and 274. Each OLED 268, 270, 272, and 274 in light emitting layer 264 can emit light in a predetermined color and brightness.

In this embodiment, driving circuit layer 266 includes a plurality of pixel circuits 278, 280, 282, and 284, each of which includes one or more thin film transistors (TFTs), corresponding to OLEDs 268, 270, 272, and 274 of subpixels 252, 254, 256, and 258, respectively. Pixel circuits 278, 280, 282, and 284 may be individually addressed by control signals 108 from control logic 104 and configured to drive corresponding subpixels 252, 254, 256, and 258, by controlling the light emitting from respective OLEDs 268, 270, 272, and 274, according to control signals 108. Driving circuit layer 266 may further include one or more drivers (not shown) formed on the same substrate as pixel circuits 278, 280, 282, and 284. The on-panel drivers may include circuits for controlling light emitting, gate scanning, and data writing as described below in detail. Scan lines and data lines are also formed in driving circuit layer 266 for transmitting scan signals and data signals, respectively, from the drivers to each pixel circuit 278, 280, 282, and 284. Display panel 260 may include any other suitable component, such as one or more glass substrates, polarization layers, or a touch panel (not shown). Pixel circuits 278, 280, 282, and 284 and other components in driving circuit layer 266 in this embodiment are formed on a low temperature polycrystalline silicon (LTPS) layer deposited on a glass substrate, and the TFTs in each pixel circuit 278, 280, 282, and 284 are p-type transistors (e.g., PMOS LTPS-TFTs). In some embodiments, the components in driving circuit layer 266 may be formed on an amorphous silicon (a-Si) layer, and the TFTs in each pixel circuit may be n-type transistors (e.g., NMOS TFTs). In some embodiments, the TFTs in each pixel circuit may be organic TFTs (OTFT) or indium gallium zinc oxide (IGZO) TFTs.

As shown in FIG. 2B, each subpixel 252, 254, 256, and 258 is formed by at least an OLED 268, 270, 272, and 274 driven by a corresponding pixel circuit 278, 280, 282, and 284. Each OLED may be formed by a sandwich structure of an anode, an organic light-emitting layer, and a cathode. Depending on the characteristics (e.g., material, structure, etc.) of the organic light-emitting layer of the respective OLED, a subpixel may present a distinct color and brightness. Each OLED 268, 270, 272, and 274 in this embodiment is a top-emitting OLED. In some embodiments, the OLED may be in a different configuration, such as a bottom-emitting OLED. In one example, one pixel may consist of three subpixels, such as subpixels in the three primary colors (red, green, and blue) to present a full color. In another example, one pixel may consist of four subpixels, such as subpixels in the three primary colors (red, green, and blue) and the white color. In still another example, one pixel may consist of two subpixels. For example, subpixels A 252 and B 254 may constitute one pixel, and subpixels C 256 and D 258 may constitute another pixel. Here, since display data 106 is usually programmed at the pixel level, the two subpixels of each pixel or the multiple subpixels of several adjacent pixels may be addressed collectively by SPRs to present the appropriate brightness and color of each pixel, as designated in display data 106 (e.g., pixel data). However, it is to be appreciated that, in some embodiments, display data 106 may be programmed at the subpixel level such that display data 106 can directly address individual subpixel without SPRs. Because it usually requires three primary colors to present a full color, specifically designed subpixel arrangements may be provided for display 102 in conjunction with SPR algorithms to achieve an appropriate apparent color resolution.

Figure 3:
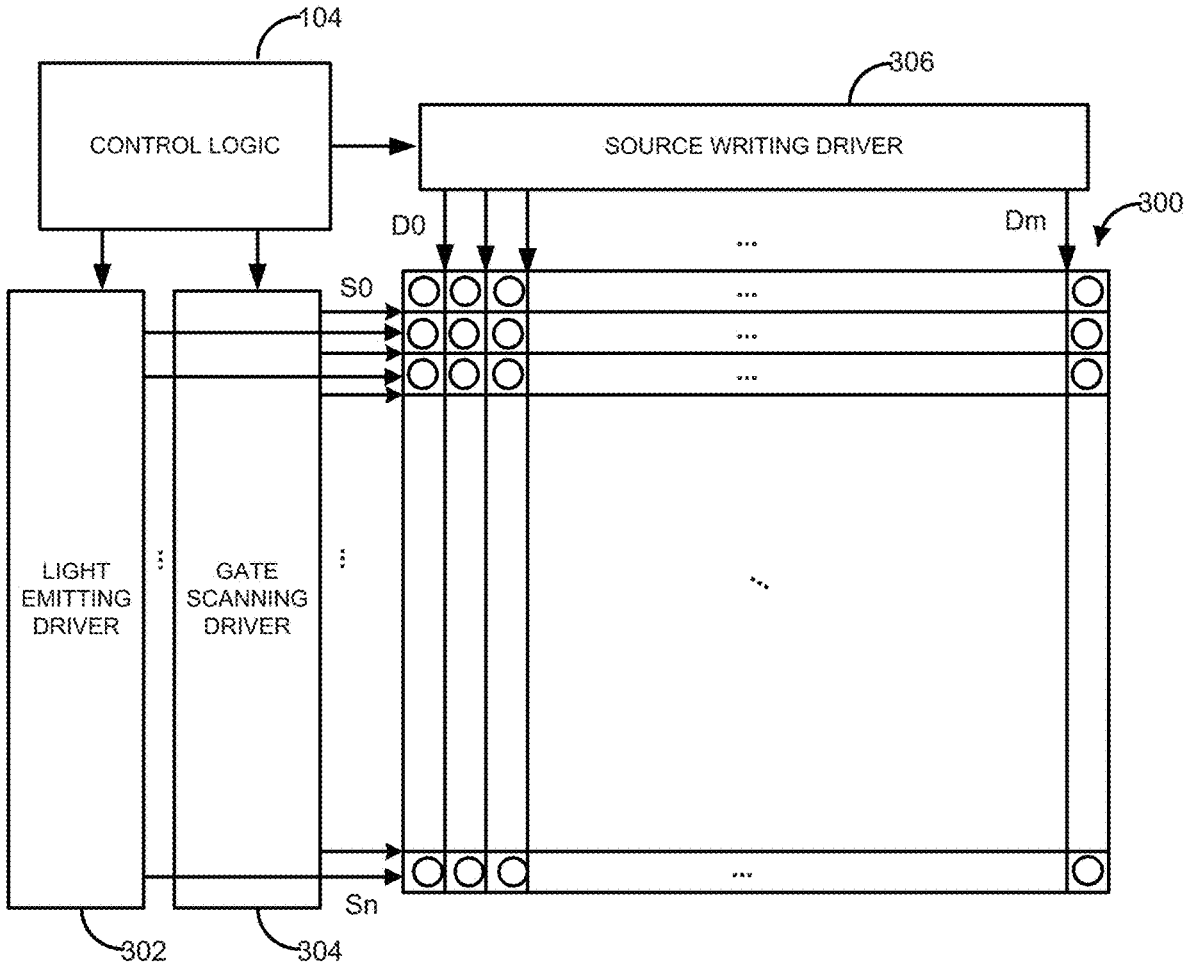
FIG. 3 is a plan-view diagram illustrating the display shown in FIG. 1 including multiple drivers in accordance with an embodiment.

FIG. 3 is a plan-view diagram illustrating driving units 103 shown in FIG. 1 including multiple drivers in accordance with an embodiment. Display panel (e.g., 210 or 260) in this embodiment includes an array of subpixels 300, a plurality of pixel circuits (not shown), and multiple on-panel drivers including a light emitting driver 302, a gate scanning driver 304, and a source writing driver 306. The pixel circuits are operatively coupled to array of subpixels 300 and on-panel drivers 302, 304, and 306. Light emitting driver 302 in this embodiment is configured to cause array of subpixels 300 to emit lights in each frame. It is to be appreciated that although one light emitting driver 302 is illustrated in FIG. 3, in some embodiments, multiple light emitting drivers may work in conjunction with each other.

Gate scanning driver 304 in this embodiment applies a plurality of scan signals S0-Sn, which are generated based on control signals 108 from control logic 104, to the scan lines (a.k.a. gate lines) for each row of subpixels in array of subpixels 300 in a sequence. The scan signals S0-Sn are applied to the gate electrode of a switching transistor of each pixel circuit during the scan/charging period to turn on the switching transistor so that the data signal for the corresponding subpixel can be written by source writing driver 306. As will be described below in detail, the sequence of applying the scan signals to each row of array of subpixels 300 (i.e., the gate scanning order) may vary in different embodiments. In some embodiments, not all the rows of subpixels are scanned in each frame. It is to be appreciated that although one gate scanning driver 304 is illustrated in FIG. 3, in some embodiments, multiple gate scanning drivers may work in conjunction with each other to scan array of subpixels 300.

Source writing driver 306 in this embodiment is configured to write display data received from control logic 104 into array of subpixels 300 in each frame. For example, source writing driver 306 may simultaneously apply data signals D0-Dm to the data lines (a.k.a. source lines) for each column of subpixels. That is, source writing driver 306 may include one or more shift registers, digital-analog converter (DAC), multiplexers (MUX), and arithmetic circuit for controlling a timing of application of voltage to the source electrode of the switching transistor of each pixel circuit (i.e., during the scan/charging period in each frame) and a magnitude of the applied voltage according to gradations of display data 106. It is to be appreciated that although one source writing driver 306 is illustrated in FIG. 3, in some embodiments, multiple source writing drivers may work in conjunction with each other to apply the data signals to the data lines for each column of subpixels.

Figure 4A:
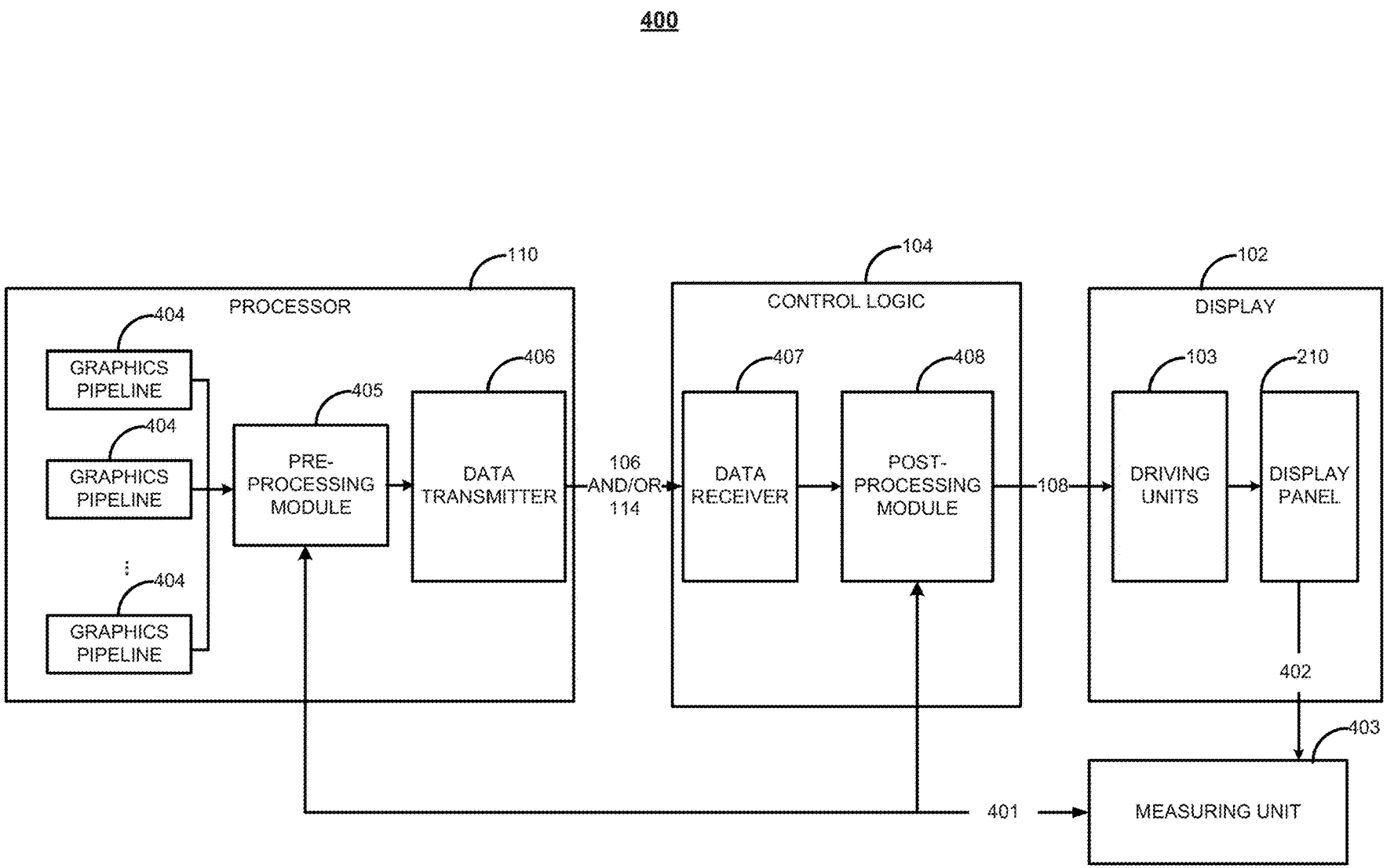
FIG. 4A is a block diagram illustrating a system including a display, a control logic, a processor, and a measuring unit in accordance with an embodiment.

FIG. 4A is a block diagram illustrating a display system 400 including a display 102, control logic 104, a measuring unit 403, and a processor 110 in accordance with an embodiment.

As described above, processor 110 may be any processor that can generate display data 106, e.g., pixel data/values, in each frame and provide display data 106 to control logic 104. Processor 110 may be, for example, a GPU, AP, APU, or GPGPU. Processor 110 may also generate other data, such as but not limited to, control instructions 114 or test signals (not shown in FIG. 4A) and provide them to control logic 104. The stream of display data 106 transmitted from processor 110 to control logic 104 may include original display data and/or compensation data for pixels on display panel 210. In some embodiments, control logic 104 includes a data receiver 407 that receives display data 106 and/or control instructions 114 from processor 110. Post-processing module 408 may be coupled to data receiver 407 to receive any data/instructions and convert them to control signals 108. Measurement data 401 may represent a bidirectional data flow. Pre-processing module 405 and/or post-processing module 408 may transmit measurement instructions (e.g., for the measurement of display panel 210) to a measuring unit 403 via measurement data 401, and measuring unit 403 may transmit any results of measurement to pre-processing module 405 and/or post-processing module 408 via measurement data 401. Receiving the measurement instructions, measuring unit 403 may perform the corresponding measurement and receive the raw measurement data from display panel 210.

In this embodiment, processor 110 includes graphics pipelines 404, a pre-processing module 405, and a data transmitter 406. Each graphics pipeline 404 may be a two-dimensional (2D) rendering pipeline or a three-dimensional (3D) rendering pipeline that transforms 2D or 3D images having geometric primitives in the form of vertices into pieces of display data, each of which corresponds to one pixel on display panel 210. Graphics pipeline 404 may be implemented as software (e.g., computing program), hardware (e.g., processing units), or combination thereof. Graphics pipeline 404 may include multiple stages such as vertex shader for processing vertex data, rasterizer for converting vertices into fragments with interpolated data, pixel shader for computing lighting, color, depth, and texture of each piece of display data, and render output unit (ROP) for performing final processing (e.g., blending) to each piece of display data and write them into appropriate locations of a frame buffer (not shown). Each graphics pipeline 404 may independently and simultaneously process a set of vertex data and generate the corresponding set of display data in parallel.

In this embodiment, graphics pipelines 404 are configured to generate a set of original display data in each frame on display panel 210/260. Each piece of the set of original display data may correspond to one pixel of the array of pixels on display panel 210/260. For example, for a display panel having a resolution of 2400×2160, the set of original display data generated by graphics pipelines 404 in each frame includes 2400×2160 pieces of the set of original display data, each of which represents a set of values of electrical signals to be applied to the respective pixel (e.g., consisting of a number of subpixels). The set of original display data may be generated by graphics pipelines 404 at a suitable frame rate (e.g., frequency) at which consecutive display frames are provided to display panel 210, such as 30 fps, 60 fps, 72 fps, 120 fps, or 240 fps.

Figure 4B:
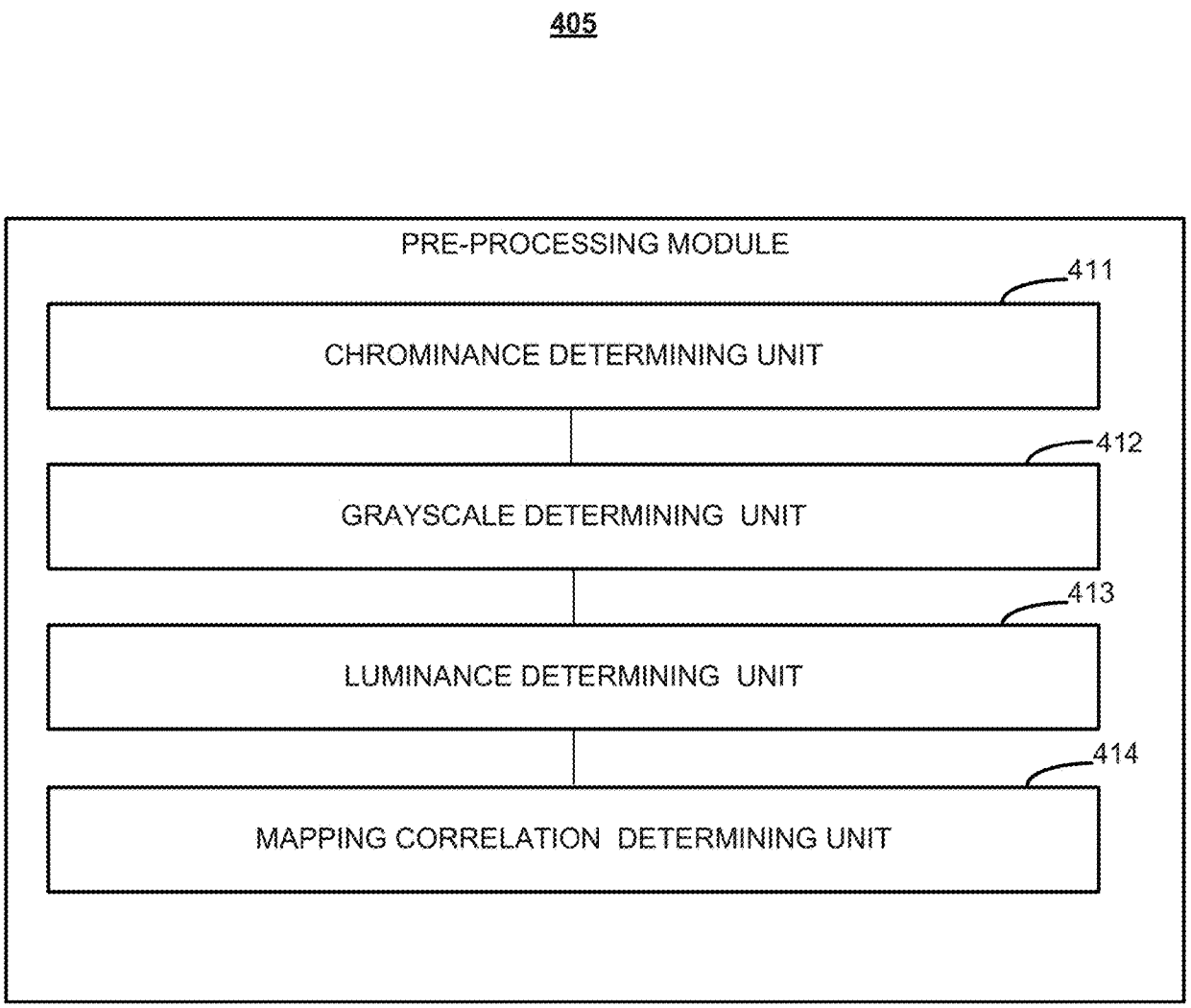
FIG. 4B is a detailed block diagram illustrating one example of a pre-processing module in the processor shown in FIG. 4A in accordance with an embodiment.
Figure 4C:
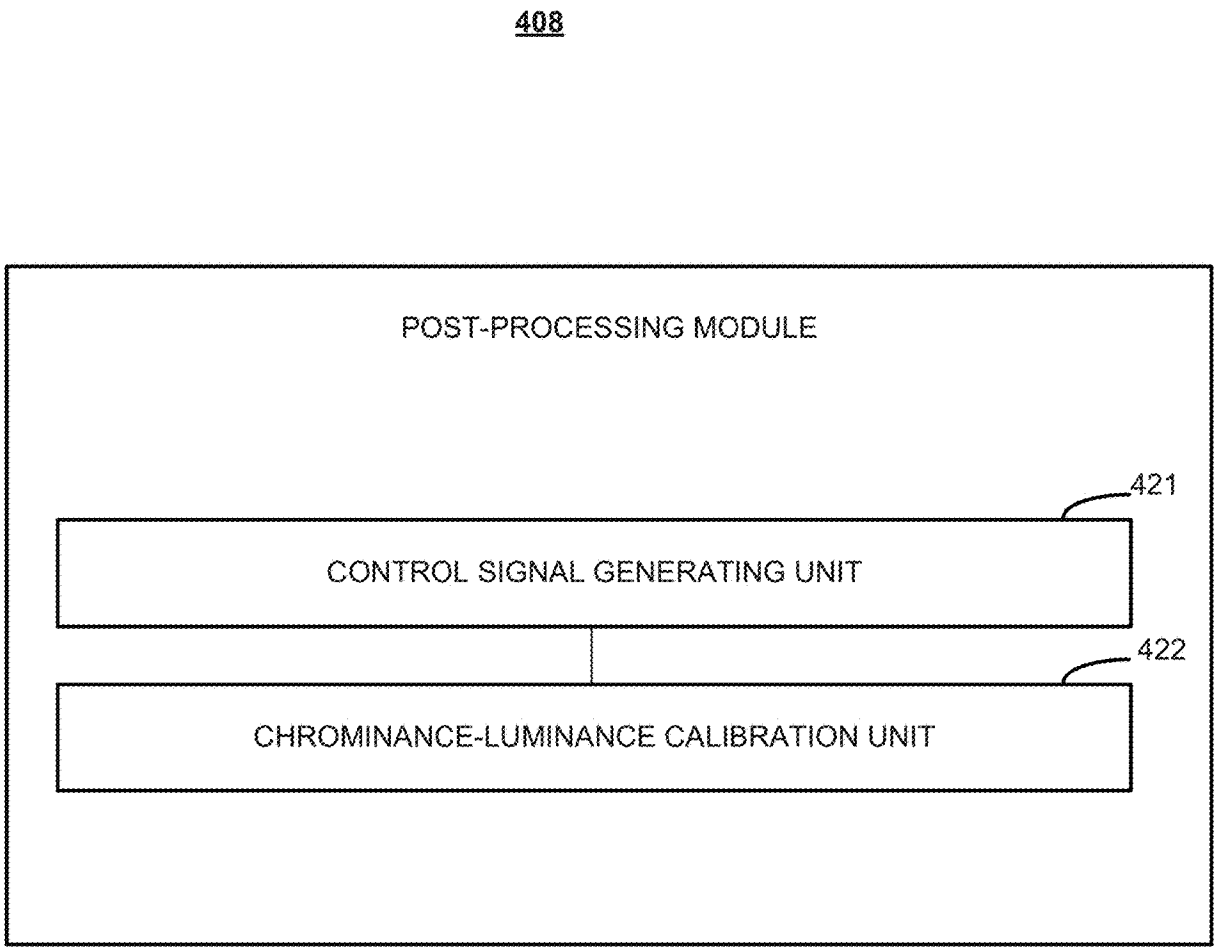
FIG. 4C is a detailed block diagram illustrating one example of a post-processing module in the control logic shown in FIG. 4A in accordance with an embodiment.
Figure 6:
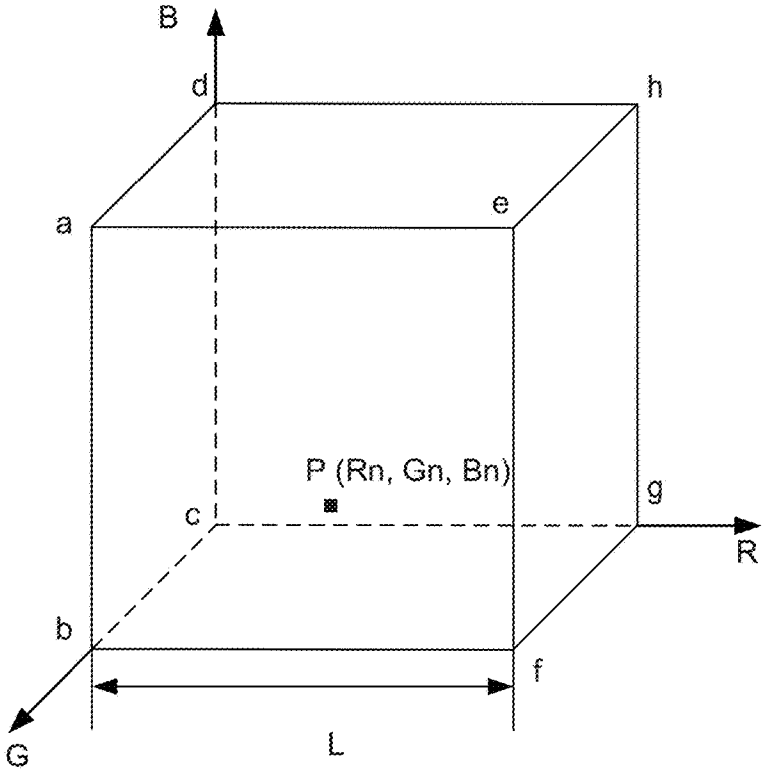
FIG. 6 is a depiction of an example of polyhedron enclosing a start point in a numerical space in accordance with an embodiment.

In this embodiment, pre-processing module 405 is operatively coupled to graphics pipelines 404 and configured to process the original display data of display panel 210/260 provided by graphics pipelines 404 to, e.g., determine pixel values. FIG. 4B is a detailed block diagram illustrating one example of pre-processing module 405 in processor 110 shown in FIG. 4A in accordance with an embodiment. FIG. 4C is a detailed block diagram illustrating one example of post-processing module 408 in control logic 104 shown in FIG. 4A in accordance with an embodiment. FIG. 5 illustrates an exemplary grayscale mapping correlation LUT of a plurality of (grayscale value, mapped pixel value) pairs in accordance with an embodiment. FIG. 6 illustrates an exemplary polyhedron 600 used in a spatial approximation method in accordance with an embodiment. In this embodiment, pre-processing module 405 includes a chrominance determining unit 411, a grayscale determining unit 412, a luminance determining unit 413, and a mapping correlation determining unit 414. Pre-processing module 405 and post-processing module 408 can have bi-directional communication with measuring unit 403 so that pre-processing module 405 and post-processing module 408 can send control instructions 114 (e.g., measuring commands 402) to measuring unit 403 and measuring unit 403 can send results of measurement data 401 to pre-processing module 405 and post-processing module 408.

In some embodiments, pre-processing module 405 determines a grayscale mapping correlation in the form of a LUT that has a plurality of grayscale values of display panel 210/260 and a plurality of sets of mapped pixel values each mapped to a respective one of the plurality of grayscale values. The grayscale mapping correlation may include at least a portion of all the grayscale values and corresponding sets of mapped pixel values. In some embodiments, all the grayscale values displayed by display panel 210/260 are included. In some embodiments, the set of mapped pixel values includes the mapped pixel value of each subpixel in a pixel for display panel 210/260 to display the corresponding grayscale value. In some embodiments, a pixel includes three subpixels that respectively display R, G, B colors. A set of mapped pixel values, corresponding to a gray scale value, can accordingly include three mapped pixel values each representing the pixel value applied on the corresponding R/G/B subpixel when the pixel is displaying the grayscale value.

In some embodiments, pre-processing module 405 first determines a range of white luminance values (e.g., actual white luminance values) of display panel 210/260 and a target first luminance value. This can be performed by luminance determining unit 413 and measuring unit 403. In some embodiments, equal pixel values are applied on subpixels of a pixel so that the pixel displays white light at a corresponding grayscale value of the pixel. For example, subpixels displaying R, G, and B colors may each be applied with a pixel value of 32 so the pixel displays a white light (e.g., having a white luminance value) at grayscale value 32. In some embodiments, the pixel values applied on each subpixels are tuned from the lowest/minimum values (e.g., (R,G,B) equal to (0, 0, 0)) to the highest/maximum values (e.g., (R,G,B) of $((2^N-1), (2^N-1), (2^N-1))$) so a range of white luminance values displayed by display panel 210/260 can be obtained. In some embodiments, N is equal to 12. In some embodiments, pre-processing module 405 (e.g., luminance determining unit 413) sends corresponding control signals/data to measuring unit 403 to perform the measurement and receives the results of measurement from measuring unit 403. In some embodiments, measuring unit 403 includes any suitable devices capable of measuring various attributes of a plurality of pixels (e.g., a block of pixels). For example, measuring unit 403 can include a colorimeter configured to measure at least the (R, G, B) attribute (e.g., first attribute) and (Y, x, y) attribute (e.g., second attribute) of pixels.

Pre-processing module 405 may determine a plurality of sets of mapped pixel values corresponding to or mapped to a plurality of grayscale values of display panel 210/260, for the grayscale mapping correlation. For example, each grayscale value may correspond to or be mapped to a set of mapped (R, G, B) values so that when the subpixels are applied with the mapped (R, G, B) values the pixel can display a desired luminance at a desired color temperature corresponding to the grayscale value. In some embodiments, pre-processing module 405 determines a target first luminance value Y1, a set of plurality of target chrominance values (x, y) of display panel 210/260, a first grayscale value V1, and a white luminance value. In some embodiments, chrominance determining unit 411 determines set of target chrominance values (x, y), grayscale determining unit 412 determines first grayscale value V1, luminance determining unit 413 determines target first luminance value Y1 and the white luminance value. In some embodiments, set of target chrominance values (x, y) determines the color temperature of display panel 210/260.

Target first luminance value Y1 may be any desired nonzero white luminance. Set of target chrominance values (x, y) may determine a desired color temperature of display panel 210/260. In some embodiments, target first luminance value Y1 and set of target chrominance values (x, y) are determined by a desired display standard. In some embodiments, target first luminance value Y1 is the target maximum luminance value of display panel 210/260. In some embodiments, a set of first target values (Y1, x, y) is employed to represent target first luminance value Y1 and target chrominance values (x, y). In some embodiments, Y1 is a positive number, and x and y are each in a range from 0 to 0.7.

First grayscale value V1 may represent any suitable grayscale value. First grayscale value V1 may correspond to or be mapped to the set of mapped pixel values (described below) determined by the mapping of target first luminance value Y1. For example, first grayscale value V1 can be equal to the highest grayscale value ($2^N-1$) displayed by display panel 210/230, and target first luminance value Y1 may be used to determine a set of mapped pixel values at (e.g., ($2^N-1$)).

The white luminance value may be a luminance value selected from the range. The white luminance value may be closest to target first luminance value Y1. Pixel values (R1, G1, B1) corresponding to the white luminance value may be used as a first set of start pixel values (R1, G1, B1) to determine the set of mapped pixel values corresponding to first grayscale value V1.

In some embodiments, pre-processing module 405 determines a first set of mapped pixel values (R1m, G1m, B1m) mapped to first grayscale value V1 in the grayscale mapping correlation. This can be performed by mapping correlation determining unit 414. An approximation method can be used to determine first set of mapped pixel values (R1m, G1m, B1m) based on start pixel values (R1, G1, B1) and first target values (Y1, x, y). In some embodiments, pre-processing module 405 also determines a first mapped luminance value and a plurality of first mapped chrominance values, e.g., (Y1m, x1m, y1m) based on the first set of mapped pixel values (R1m, G1m, B1m). Details of the approximation method are described as follows.

In some embodiments, pre-processing module 405 determines a target luminance-grayscale correlation γ, a target second luminance value Y2, a second target grayscale value V2, and a second set of start pixel values (R2, G2, B2). In some embodiments, grayscale determining unit 412 determines second target grayscale value V2, mapping correlation determining unit 414 determines target luminance-grayscale correlation γ, and luminance determining unit 413 determines target second luminance value Y2 and second set of start pixel values (R2, G2, B2). Target luminance-grayscale correlation γ may be a normalized luminance-grayscale correlation reflecting a desired correlation between the luminance values and grayscale values of a pixel. Target luminance-grayscale correlation γ may be used to determine a second set of start pixel values for each subpixel and a target second luminance value. Target luminance-grayscale correlation γ may include a plurality of normalized luminance values mapped to a plurality of grayscale values ranging from 0 to ($2^N-1$).

Second grayscale value V2 may represent any suitable grayscale value less than first grayscale value V1. Second grayscale value V2 may correspond to the set of mapped pixel values determined by the mapping of a target second luminance value (described below). In some embodiments, pre-processing module 405 determines the second set of start pixel values (R2, G2, B2) corresponding to second grayscale value V2 based on the first set of mapped pixel values (R1m, G1m, B1m) and target luminance-grayscale correlation γ. In some embodiments, each one of the second set of start pixel values (R2, G2, B2) is proportional to a corresponding one of first set of mapped pixel values (R1m, G1m, B1m) and second grayscale value V2. For example, second grayscale value V2 may be ($2^K-1$), first grayscale value V1 may be ($2^N-1$), then R2 may be equal to $((2^K-1)/(2^N-1)\times R1m)$. Similarly, G2 may be equal to $((2^K-1)/(2^N-1)\times G1m$, and B2 may be equal to $((2^K-1)/(2^N-1)\times B1m)$. In some embodiments, K is a positive integer less than N.

In some embodiments, pre-processing module 405 determines a target second luminance value Y2 for determining a second set of mapped pixel values (R2m, G2m, B2m), which can be determined by mapping correlation determining unit 414. The second set of mapped pixel values (R2m, G2m, B2m) may be mapped to second grayscale value V2 in the grayscale mapping correlation. In some embodiments, target second luminance value Y2 is proportional to first mapped luminance value Y1m and a normalized luminance value $\gamma_2$ mapped to second grayscale value V2 in target luminance-grayscale correlation. For example, at grayscale V2, target second luminance value Y2 may be equal to $Y1m\times\gamma_2$.

In some embodiments, pre-processing module 405 (e.g., mapping correlation determining unit 414) determines the second set of mapped pixel values (R2m, G2m, B2m) using the same approximation method for determining first set of mapped pixel values (R1m, G1m, B1m). Details of the approximation method are described as follows.

In some embodiments, pre-processing module 405 determines a plurality of sets of start pixel values corresponding to a plurality of grayscale values other than second grayscale value V2 and first grayscale value V1. Methods similar to or the same as the method used to determine V2 and (R2, G2, B2) can be used to determine these other grayscale values and their corresponding sets of start pixel values. In some embodiments, V1 is equal to ($2^N-1$) and a linear interpolation method is used to determine a plurality of intermediate grayscale values (e.g., including V2) between 0 and V1. A set of start pixel values corresponding to each grayscale value may also be determined. In some embodiments, a similar or same spatial approximation method is used to determine the sets of mapped pixel values corresponding to these grayscale values.

For example, if display panel 210/230 has a bit number N=12, the grayscale mapping correlation may include grayscale values 0, 4, 8, 12, . . . , 4095, and a set of mapped pixel values mapped to each one of the grayscale values. The number of grayscale values chosen for determining the gray scale mapping correlation should not be limited by the embodiments of the present disclosure. The sets of mapped pixel values for the grayscale values not included in the grayscale mapping correlation may be determined by, e.g., an interpolation method.

FIG. 5 illustrates an exemplary grayscale mapping correlation in the form of a LUT, according to an embodiment. The first column may include a plurality of grayscale values 0, 4, 8, 12, . . . 4095. The second, third, and fourth column may each represent a plurality of mapped pixel values of a respective subpixel/color. Each row of the LUT includes a grayscale value and the respective set of mapped pixel values for the three subpixels/colors. For example, grayscale value 4 is mapped to a set of mapped pixel values of (43, 46, 30), where (43, 46, 30) represents pixel values applied on subpixels displaying R, G, and B colors when the pixel is displaying a grayscale value equal to 4.

In some embodiments, pre-processing module 405 determines the set of mapped pixel values mapped to a grayscale value by employing an approximation method. In some embodiments, the respective set of start pixel values (e.g., (R1, G1, B1) and (R2, G2, B2)) may be employed to determine a start point in an RGB space, of which the coordinate system represents pixel values of R, G, and B colors, e.g., the R axis, G axis, and B axis. The set of start pixel values may be the coordinates, of the start point, along the R, G, and B axes. The approximation method/process can be performed by mapping correlation determining unit 414 and measuring unit 403.

In some embodiments, pre-processing module 405 determines a polyhedron that encloses the start point in the RGB space. The polyhedron may have a plurality of vertices and an enclosing diameter. The enclosing diameter may be sufficiently large for the polyhedron to enclose the start point in the RGB space. The polyhedron may have any suitable shape such as a tetrahedron, a pentahedron, a hexahedron, a heptahedron, an octahedron, an enneahedron, or an icosahedron. For ease of illustration, in the present disclosure, a cube is employed to describe the approximation method. FIG. 6 illustrates a start point P enclosed by a cube having eight vertices a, b, c, d, e, f, g, h. In some embodiments, P is located in the cube in the RGB space. In some embodiments, the enclosing diameter of the cube may be a length L of the cube and P is located at the geometric center of the cube. In some embodiments, assuming the coordinates of P (e.g., the set of start pixel values) is (Rn, Gn, Bn), n being equal to 1 or 2, and the coordinates of respective vertices a, b, c, d, e, f, g, h may be (Ra, Ga, Ba), (Rb, Gb, Bb), (Rc, Gc, Bc), (Rd, Gd, Bd), (Re, Ge, Be), (Rf, Gf, Bf), (Rg, Gg, Bg), (Rh, Gh, Bh). The coordinates of vertices a, b, c, d, e, f, g, h may respectively be equal to (Rn−d/2, Gn+d/2, B+d/2), (Rn−d/2, Gn+d/2, Bn−d/2), (Rn−d/2, Gn−d/2, Bn−d/2), (Rn−d/2, Gn−d/2, Bn+d/2), (Rn+d/2, Gn+d/2, Bn+d/2), (Rn+d/2, Gn+d/2, Bn−d/2), (Rn+d/2, Gn+d/2, Bn−d/2), and (Rn+d/2, Gn−d/2, Bn+d/2).

In some embodiments, pre-processing module 405 and measuring unit 403 may determine a plurality of sets of vertex values each includes a vertex luminance value and a plurality of vertex chrominance values. Each of the plurality of sets of vertex values corresponds to a respective one of the vertices. In some embodiments, pre-processing module 405 sends control instructions 114 to tune display panel 210/260 by separately applying the coordinate of each vertex on pixels of display panel 210/260. Measuring unit 403 may measure the respective vertex luminance value and chrominance values of display panel 210/260 when the coordinates of each vertex are applied and transmit the results of measurement to pre-processing module 405 for subsequent processing.

In some embodiments, pre-processing module 405 converts the plurality of sets of vertex values, each including a vertex luminance and a plurality of vertex chrominance values, into a plurality of sets of vertex coordinates in a XYZ color space. XYZ may be a three-dimensional color space that can be employed to determine geometric correlation between objects. The coordinate system of the XYZ color space represents values of X, Y, and Z, e.g., the X axis, Y axis, and Z axis. In some embodiments, pre-processing module 405 also converts a respective set of target values into a respective set of target coordinates in the XYZ color space. The respective set of target values includes a target luminance value and the target chrominance values (e.g., (Y1, x, y) and (Y2, x, y)).

In some embodiments, pre-processing module 405 determines a distance between the respective start point P and each face of the polyhedron (e.g., faces Fabcd, Faefb, Fehgf, Fhdcg, Fdhea, and Fcgfb) in the RGB space. This distance can be approximated by the distance between the respective set of target coordinates to a transformed face of each of these faces in the XYZ color space. For example, after vertices a, b, c, and d are converted from the RGB space to the XYZ color space, face Fabcd may be transformed to a transformed surface Fabcd'. In some embodiments, pre-processing module 405 determines a weighing of each of the plurality of vertices on the respective start point P in the RGB space based on the distances in the XYZ color space. In some embodiments, the weighing of vertices a, b, c, d, e, f, g, and h on respective start point P may respectively be Wa, Wb, Wc, Wd, We, Wf, Wg, and Wh, in the RGB space. Details of the method to determine the weighing are described as follows.

In some embodiments, pre-processing module 405 determines a set of new start coordinates in the RGB space based on the weighing of each vertices on the respective start point P in the RGB space and the coordinates of respective vertices. The set of new start coordinates (Rn', Gn', Bn') may correspond to a new start point P' (not shown in FIG. 6). In some embodiments, Rn' is equal to (Ra×Wa+Rb×Wb+Rc×Wc+Rd×Wd+Re×We+Rf×Wf+Rg×Wg+Rh×Wh), where Ra, Rb, Rc, Rd, Re, Rf, Rg, and Rh are each the respective coordinate of vertices a, b, c, d, e, f, g, and h along the R axis (e.g., R component of the set of coordinates). Similarly, Gn' is equal to (Ga×Wa+Gb×Wb+Gc×Wc+Gd×Wd+Ge×We+Gf×Wf+Gg×Wg+Gh×Wh) and Bn' is equal to (Ba×Wa+Bb×Wb+Bc×Wc+Bd×Wd+Be×We+Bf×Wf+Bg×Wg+Bh×Wh).

In some embodiments, pre-processing module 405 may send control instructions 114 to display panel 210/260 to apply the set of new start coordinates (Rn', Gn', Bn') on respective subpixels of a pixel. Measuring unit 403 may measure the new luminance value and a plurality of new chrominance value when the set of new start coordinates (Rn', Gn', Bn') are applied, and transmit the results of measurement to pre-processing module 405 for subsequent processing. Pre-processing module 405 may then determine whether the new luminance value and the new chrominance value each satisfies predetermined criteria, such as a range of luminance values and/or a range of chrominance values.

If it is determined the new luminance value and the new chrominance value each satisfies predetermined criteria, pre-processing module 405 determines new start coordinates (Rn', Gn', Bn') to be the respective set of mapped pixel values of the respective grayscale value (e.g., V1 or V2). If it is determined one or more of the new luminance value and the new chrominance value do not satisfy the predetermined criteria, pre-processing module 405 may determine new start coordinates (Rn', Gn', Bn') to be the new coordinates of start point P, and reduce the enclosing diameter of the polyhedron. The polyhedron may still enclose start point P. Pre-processing module 405 may repeat the process to determine the respective set of mapped pixel values until the new luminance value and the new chrominance value of the new start coordinates (Rn', Gn', Bn') each satisfies predetermined.

In some embodiments, pre-processing module 405 approximates the distance between the respective start point P and each vertex in the RGB space with the distance between the respective set of target coordinates and each set of vertex coordinates in the XYZ color space. The distance between the respective set of target coordinates and each set of vertex coordinates in the XYZ color space can be used to determine the weighing of each vertex to respective start point P in the RGB space. For ease of illustration, the weighing of vertex a is described.

Referring back to FIG. 6, in RGB space, the cube includes six faces, i.e., Fabcd, Faefb, Fehgf, Fhdcg, Fdhea, and Fcgfb, formed by vertices a, b, c, d, e, f, g, and h. The distances between start point P and each of the six faces of the cube (i.e., Fabcd, Faefb, Fehgf, Fhdcg, Fdhea, and Fcgfb) are respectively Dabcd, Daefb, Dehgf, Dhdcg, Ddhea, and Dcgfb in the RGB space. As previously described, the coordinates of the vertices are transformed from the RGB space to the XYZ color space. The distance between respective start point P and faces Fabcd, Faefb, Fehgf, Fhdcg, Fdhea, and Fcgfb in the RGB space (i.e., Dabcd, Daefb, Dehgf, Dhdcg, Ddhea, and Dcgfb) can each be approximated by the distance between the respective target coordinates and a respective transformed face in the XYZ color space. For example, vertices a, b, c, and d may form face Fabcd in the RGB space, and may form a transformed face Fabcd' in the XYZ color space after being converted into the XYZ color space.

Accordingly, the weighting of vertex a on start point P along the R axis (i.e., a sub-weighing in the RGB space) can then be calculated as WaR=1−Dabcd/(Dabcd+Dehgf), where Dabcd and Dehgf represent the distances between the respective set of target coordinates to the two transformed faces of Fabcd' and Fehgf' in the XYZ. In some embodiments, respective start point P is located between faces Fabcd and Fehgf along the R axis in the RGB space. Similarly, the weighting of vertex a on start point P along the G axis can be calculated as WaG=1−Daefb/(Daefb+Dhdcg), and weighting of vertex a on start point P along the B axis can be calculated as WaG=1−Ddhea/(Ddhea+Dcgfb). The weighing of vertex a on start point P can be calculated as Wa=WaR×WaG×WaB. Similarly, the weighing of vertices b, c, d, e, f, g, h, which are Wb, Wc, Wd, We, Wf, Wg, Wh, can then be calculated. Rn', Gn', and Bn' can then be calculated.

The distance between a point (e.g., a respective set of target coordinates) and a surface (e.g., a transformed surface from the RGB space) in the XYZ color space is described as follows. For ease of description, the calculation of distance Dabcd (e.g., between start P and transformed face Fabcd') is described as follows as an example. Assuming sets of vertex coordinate of a, b, c, d form four sub-faces Fabc, Fbcd, Facd, and Fabd in the XYZ color space, and the distances between the respective target coordinates and the four sub-faces can respectively be Dabc, Dbcd, Dacd, and Dabd. Distance Dabcd may be calculated as an average of the four distances, i.e., (Dabd+Dbcd+Dacd+Dabd)/4. Similarly, other distances Daefb, Dehgf, Dhdcg, Ddhea, and Dcgfb in the XYZ color space can be determined. Each of these distances determined in the XYZ color space can be used to approximate a corresponding distance in the RGB space for determining a sub-weighing of a respective vertex.

In some embodiments, pre-processing module 405 (e.g., mapping correlation determining unit 414) and measuring unit 403 may perform the approximation process for all the grayscale values, e.g., selected, in the grayscale mapping correlation, and determine a set of mapped pixel values for each grayscale values in the grayscale mapping correlation (e.g., grayscale mapping correlation LUT like FIG. 5). In some embodiments, mapping correlation determining unit 414 determines sets of mapped pixel values mapped to grayscale values not included in the grayscale mapping correlation by, e.g., interpolation.

FIG. 4C illustrates a detailed block diagram illustrating one example of post-processing module 408 in control logic 104 shown in FIG. 4A in accordance with an embodiment. Post-processing module 408 may include a control signal generating unit 421 and a chrominance-luminance calibration unit 422. Control logic 104 may include any other suitable components, such as an encoder, a decoder, one or more processors, controllers, and storage devices. Control logic 104 may be implemented as a standalone integrated circuit (IC) chip, such as an application-specific integrated circuit (ASIC) or a field-programmable gate array (FPGA). Control signal generating unit 421 may generate control signals 108 based on any suitable control instructions, e.g., display data 106 and/or control instructions 114, and apply control signals 108 on driving units 103. Chrominance-luminance calibration unit 422 may include at least a portion of the function of units 411-414. In some embodiments, chrominance-luminance calibration unit 422 includes the functions of chrominance determining unit 411, grayscale determining unit 412, luminance determining unit 413, and mapping correlation determining unit 414.

In some embodiments, control signal generating unit 421 includes a timing controller (TCON) and a clock signal generator. The TCON may provide a variety of enable signals to driving units 103 of display 102. The clock signal generator may provide a variety of clock signals to driving units 103 of display 102. As described above, control signals 108, including the enable signals and clock signals, can control gate scanning driver 304 to scan corresponding rows of pixels according to a gate scanning order and control source writing driver 306 to write each set of display data (e.g., pixel values to be inputted into subpixels) according to the order of pieces of display data in the set of display data. In other words, control signals 108 can cause the pixels in display panel 210 to be refreshed following a certain order at a certain rate.

Data transmitter 406 may be any suitable display interface between processor 110 and control logic 104, such as but not limited to, display serial interface (DSI), display pixel interface (DPI), and display bus interface (DBI) by the Mobile Industry Processor Interface (MIPI) Alliance, unified display interface (UDI), digital visual interface (DVI), high-definition multimedia interface (HDMI), and DisplayPort (DP). Based on the specific interface standard adopted by data transmitter 406, stream of display data 106 may be transmitted in series in the corresponding data format along with any suitable timing signals, such as vertical synchronization (V-Sync), horizontal synchronization (H-Sync), vertical back porch (VBP), horizontal back porch (HBP), vertical front porch (VFP), and horizontal front porch (HVP), which are used to organize and synchronize stream of display data 106 in each frame with the array of pixels on display panel 210.

Figure 7:
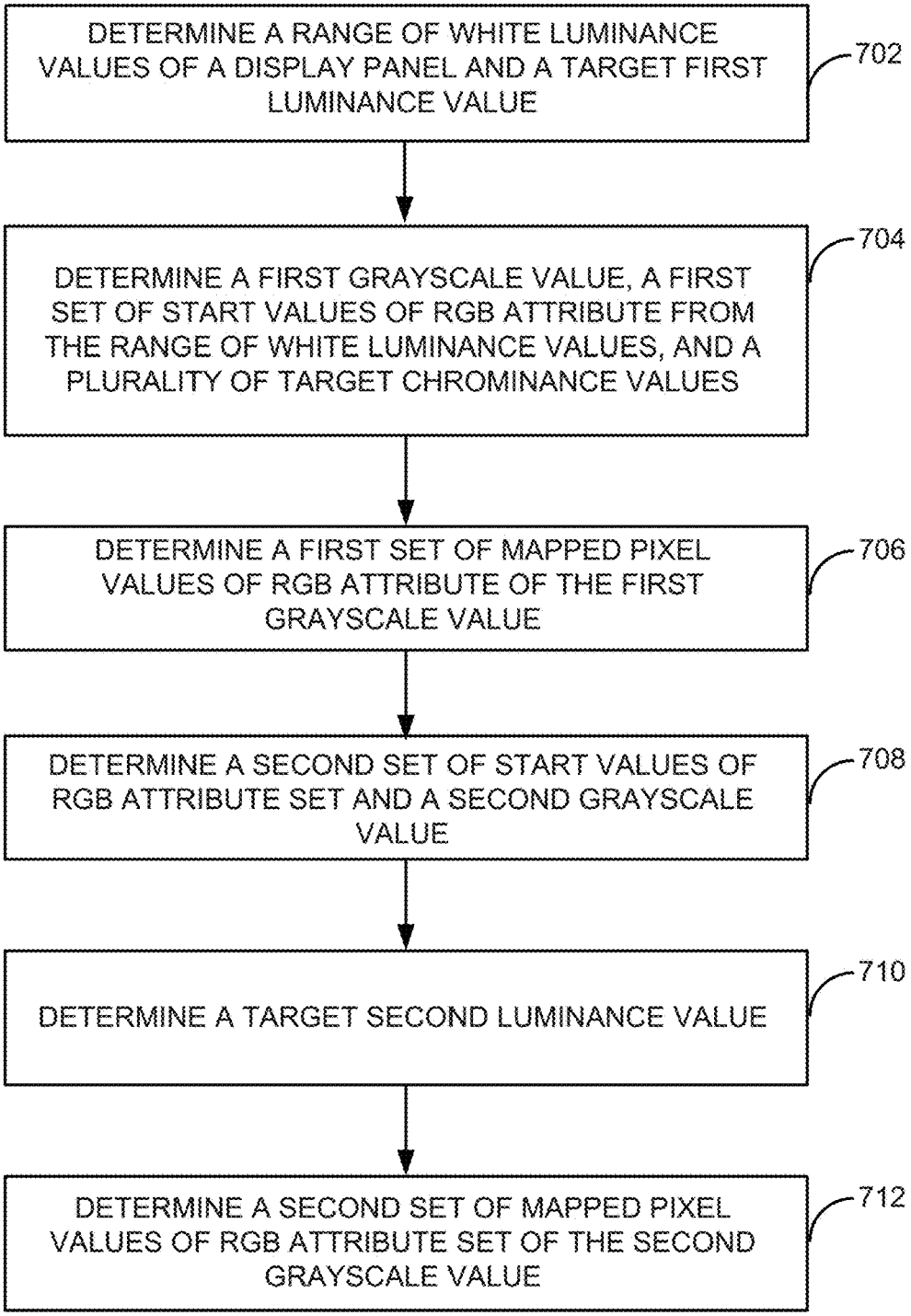
FIG. 7 is a depiction of an exemplary method for determining a grayscale mapping correlation in accordance with an embodiment.

FIG. 7 is a flow chart of a method 700 for determining a plurality of sets of mapped pixel values mapped to a plurality of gray scale values in a grayscale mapping correlation in accordance with an embodiment. It will be described with reference to the above figures, such as FIGS. 4A-6. However, any suitable circuit, logic, unit, or module may be employed. The method can be performed by any suitable circuit, logic, unit, or module that can comprise hardware (e.g., circuitry, dedicated logic, programmable logic, microcode, etc.), software (e.g., instructions executing on a processing device), firmware, or a combination thereof. It is to be appreciated that not all steps may be needed to perform the disclosure provided herein. Further, some of the steps may be performed simultaneously, or in a different order than shown in FIG. 7, as will be understood by a person of ordinary skill in the art.

Starting at 702, a range of white luminance values of a display panel may be determined. A target first luminance value may be determined based on the range of white luminance values. In some embodiments, the target first luminance value is a target maximum white luminance value of the grayscale mapping correlation. This can be performed by pre-processing module 405, post-processing module 408, and/or measuring unit 403. At 704, a first grayscale value and a first set of start pixel values of RGB attribute may be determined by selecting a set of pixel values from the range of white luminance values. The selected set of pixel values may be any suitable value less than or equal to the actual maximum white luminance value in the range. The first set of start pixel values of RGB attribute may be employed to determine a first set of mapped pixel values mapped to the first grayscale value. In some embodiments, the first grayscale value is the highest grayscale value in the grayscale mapping correlation. A plurality of target chrominance values may be determined. This can be performed by pre-processing module 405 and/or post-processing module 408. At 706, the first set of mapped pixel values of RGB attribute mapped to a first grayscale value may be determined. A first mapped luminance value corresponding to the first set of mapped pixel values of RGB attribute can be determined. This can be performed by pre-processing module 405, post-processing module 408, and/or measuring unit 403.

At 708, a second grayscale value and a second set of start pixel values of RGB attribute may be determined. The second set of start pixel values of RGB attribute may be determined based on the first set of mapped pixel values. The second grayscale value can be a suitable grayscale value less than the first grayscale value. The second set of start pixel values of RGB attribute may be employed to determine a second set of mapped pixel values mapped to the second grayscale value. This can be performed by pre-processing module 405 and/or post-processing module 408. At 710, a target second luminance value may be determined. The target second luminance value may be a suitable luminance value less than the target first luminance value and may be determined based on the first mapped luminance value. This can be performed by pre-processing module 405 and/or post-processing module 408. At 712, the second set of mapped pixel values of RGB attribute mapped to a second grayscale value can be determined. This can be performed by pre-processing module 405, post-processing module 408, and/or measuring unit 403.

Figure 8A:
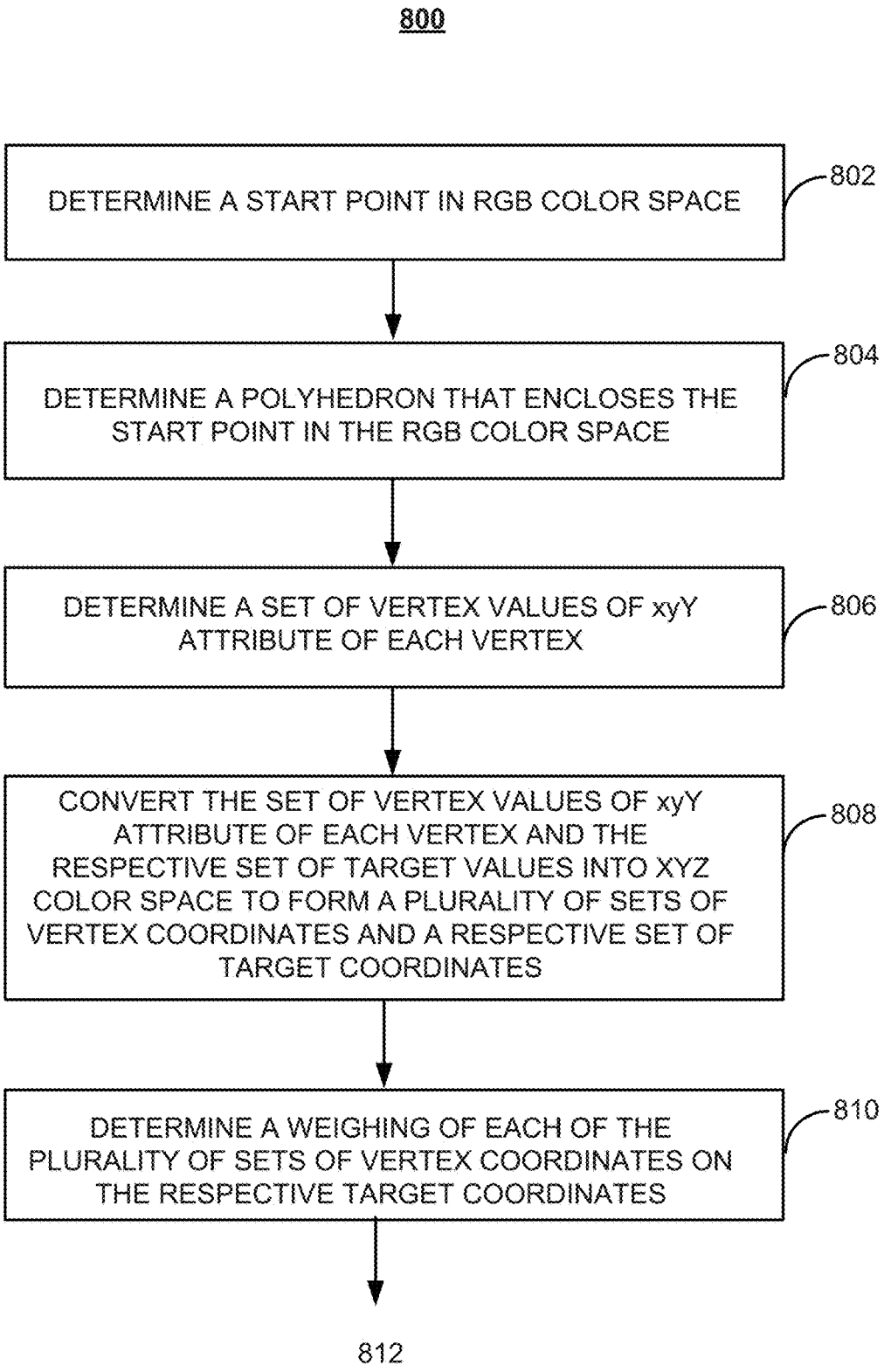
FIGS. 8A and 8B depict an exemplary method for determining a set of mapped pixel values in accordance with an embodiment.
Figure 8B:
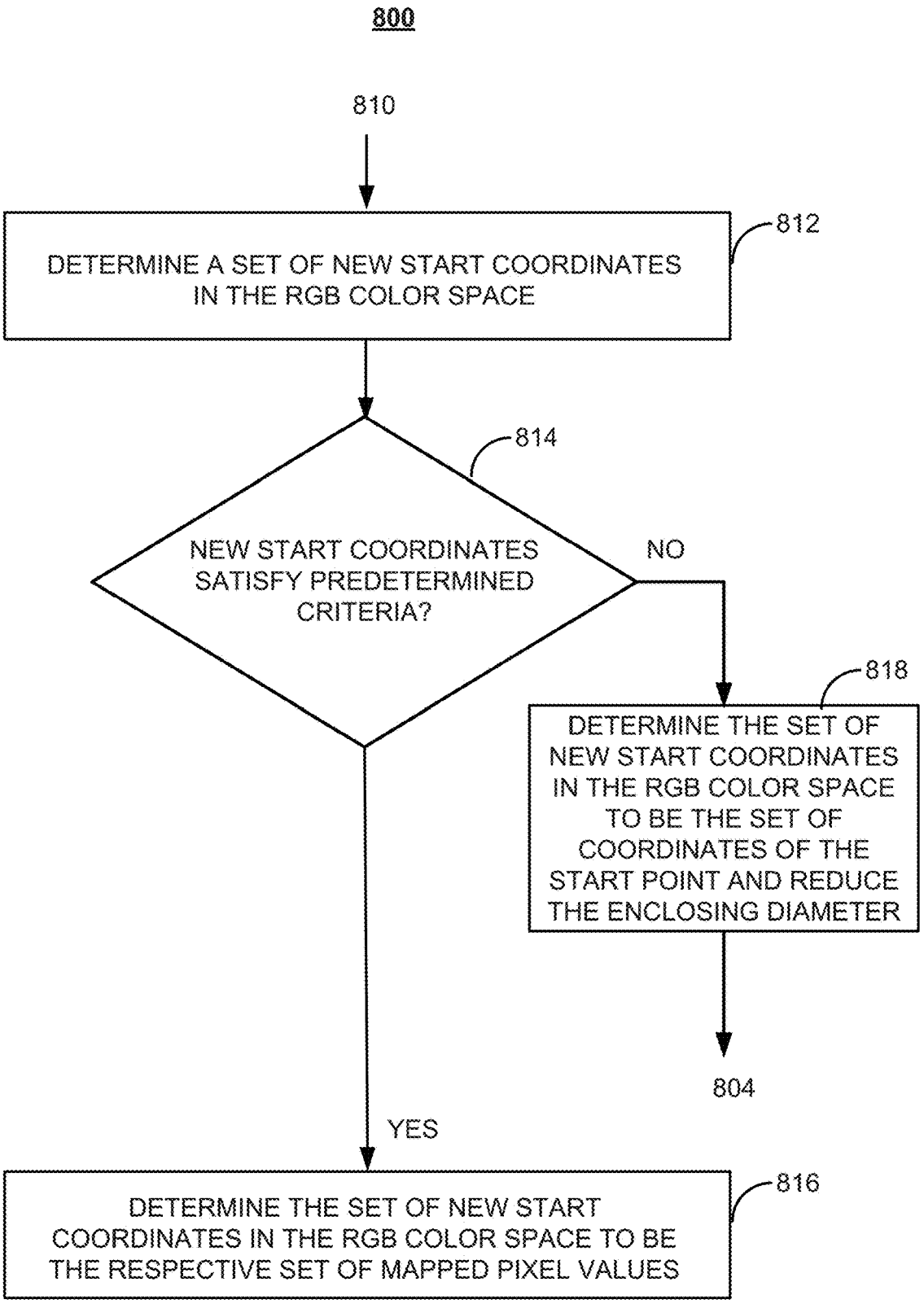

FIG. 8 is a flow chart of method 800 for determining a set of mapped pixel values mapped to a grayscale value, in accordance with an embodiment. For ease of illustration, FIG. 8 is divided into FIG. 8A and FIG. 8B (a continuation of FIG. 8A). It will be described with reference to the above figures, e.g., FIGS. 4A-6. However, any suitable circuit, logic, unit, or module may be employed. The method can be performed by any suitable circuit, logic, unit, or module that can comprise hardware (e.g., circuitry, dedicated logic, programmable logic, microcode, etc.), software (e.g., instructions executing on a processing device), firmware, or a combination thereof. It is to be appreciated that not all steps may be needed to perform the disclosure provided herein. Further, some of the steps may be performed simultaneously, or in a different order than shown in FIG. 8, as will be understood by a person of ordinary skill in the art.

Starting at 802, a start point may be determined in an RGB space. The set of coordinates of the start point may be equal to the set of start pixel values of RGB attribute. This can be performed by pre-processing module 405 and/or post-processing module 408. At 804, a polyhedron that encloses the start point may be determined in the RGB space. The polyhedron may have a plurality of vertices and an enclosing diameter. This can be performed by pre-processing module 405 and/or post-processing module 408. At 806, a set of vertex values of xyY attribute may be determined for each vertex. Each set of vertex values, corresponding to a respective vertex, may include a luminance value and a plurality of chrominance values. This can be performed by pre-processing module 405, post-processing module 408, and/or measuring unit 403. At 808, the set of vertex values of xyY attribute of each vertex and the respective set of target values may be converted into XYZ color space to form a plurality of sets of vertex coordinates and a respective set of target coordinates in the XYZ color space. This can be performed by pre-processing module 405 and/or post-processing module 408. At 810, a weighing of each of the plurality of vertex coordinates on the respective target coordinates in the XYZ color space may be determined. This can be performed by pre-processing module 405 and/or post-processing module 408.

At 812, a set of new start coordinates in the RGB space may be determined. The new start coordinates may be determined based on the weighing of each of the plurality of vertex coordinates on the respective target coordinates in the XYZ color space and the pixel values of each vertices of the polyhedron in the RGB space. This can be performed by pre-processing module 405 and/or post-processing module 408. At 814, it can be determined whether the new start coordinates each satisfies predetermined criteria. A new luminance value and a plurality of new chrominance values corresponding to the new start coordinates may be measured to determine whether they each satisfy a respective predetermined criterion. This can be performed by pre-processing module 405, post-processing module 408, and/or measuring unit 403. If yes, the process proceeds to operation 816. Otherwise, the process proceeds to operation 818. At 816, the set of new start coordinates in the RGB space may be determined to be the respective set of mapped pixel values. This can be performed by pre-processing module 405 and/or post-processing module 408. At 818, the set of new start coordinates in the RGB space may be determined to be the set of coordinates of the start point, and the enclosing diameter of the polyhedron may be reduced. This can be performed by pre-processing module 405 and/or post-processing module 408.

Integrated circuit design systems (e.g. work stations) are known that create wafers with integrated circuits based on executable instructions stored on a computer-readable medium such as but not limited to CDROM, RAM, other forms of ROM, hard drives, distributed memory, etc. In the present disclosure, the instructions may be represented by any suitable language such as but not limited to hardware descriptor language (HDL), Verilog or other suitable language. As such, the logic, units, and circuits described herein may also be produced as integrated circuits by such systems using the computer-readable medium with instructions stored therein.

For example, an integrated circuit with the aforedescribed logic, units, and circuits may be created using such integrated circuit fabrication systems. The computer-readable medium stores instructions executable by one or more integrated circuit design systems that causes the one or more integrated circuit design systems to design an integrated circuit. In one example, the designed integrated circuit includes a graphics pipeline, a pre-processing module, and a data transmitter. The graphics pipeline is configured to generate a set of original display data in each frame. The pre-processing module is configured to determine the sets of mapped pixel values mapped to respective grayscale values in the grayscale mapping correlation. The data transmitter is configured to transmit, to control logic operatively coupled to the display, in each frame, a stream of display data comprising the grayscale mapping correlation in the form of a grayscale mapping correlation LUT.

The above detailed description of the disclosure and the examples described therein have been presented for the purposes of illustration and description only and not by limitation. It is therefore contemplated that the present disclosure covers any and all modifications, variations or equivalents that fall within the spirit and scope of the basic underlying principles disclosed above and claimed herein.

What is claimed is:

1. A method for determining a grayscale mapping correlation in a display panel, comprising:

determining a target first luminance value of the display panel;

determining, of a first grayscale value, a first set of start pixel values of a first attribute based on the first grayscale value and the target first luminance value of the display panel;

determining, mapped to the first grayscale value, a first set of mapped pixel values of the first attribute and a first mapped luminance value based on the first set of start pixel values of the first attribute and a set of first target values of a second attribute, the set of first target values of the second attribute comprising a plurality of target chrominance values and the target first luminance value;

determining, of a second grayscale value, a second set of start pixel values of the first attribute based on the first set of mapped pixel values of the first attribute and a target luminance-grayscale correlation, the second grayscale value being less than the first grayscale value;

determining a target second luminance value of the display panel based on the second grayscale value, the first mapped luminance value and the target luminance-grayscale correlation; and determining, mapped to the second grayscale value, a second set of mapped pixel values of the first attribute based on the second start set of start pixel values of the first attribute, and a set of second target values comprising the plurality of target chrominance values and the target second luminance value.

2. The method of claim 1, wherein determining, mapped to the first grayscale value, a first set of mapped pixel values of the first attribute and determining, mapped to the second grayscale value, a second set of mapped pixel values of the second attribute comprises:

determining, in a numerical space corresponding to the first attribute, a respective start point having the respective set of start pixel values to be a respective set of start coordinates;

determining, in the numerical space, a polyhedron having a plurality of vertices and an enclosing diameter, the polyhedron enclosing the respective start point;

determining, of the plurality of vertices, a plurality of sets of vertex values of the second attribute, each of the plurality of sets of vertex values of the second attribute comprising a respective set of chrominance values and a respective luminance value;

converting the plurality of sets of vertex values of the second attribute into a plurality of sets of vertex coordinates of another color space, and the respective set of target values into a respective set of target coordinates of the other color space, the other color space being a three-dimensional color space;

determining, in the other color space, a distance between the respective set of target coordinates and each transformed face of the polyhedron, each transformed face being a transformation of a corresponding face of the polyhedron in the numerical space; and determining, in the numerical space, a set of new start coordinates based on a weighing of each of the plurality of vertices on the respective start point, the weighing being based on the distance between the respect set of target coordinates and each transformed face of the polyhedron.

3. The method of claim 2, further comprising:

determining whether the set of new start coordinates in the numerical space satisfies predetermined criteria; and determining the set of new start coordinates in the numerical space to be the respective set of mapped pixel values in response to the set of new start coordinates in the numerical space satisfying the predetermined criteria.

4. The method of claim 3, further comprising: in response to the set of new start coordinates in the numerical space not satisfying the predetermined criteria, determining the set of new start coordinates in the numerical space to be the respective set of start pixel values of the respective start point;

reducing the enclosing diameter of the polyhedron;

enclosing the respective start point with the polyhedron; and calculating the set of new start coordinates until the set of new start coordinates satisfies the predetermined criteria.

5. The method of claim 4, wherein determining whether the set of new start coordinates in the numerical space satisfies predetermined criteria comprises:

measuring a set of new color values of the second attribute corresponding to the respective set of start pixel values of the respective start point of the first attribute, the set of new color values of the second attribute comprising a new luminance value and a plurality of new chrominance values; and determining the new luminance value and the plurality of new chrominance values are each within a respective predetermined range.

6. The method of claim 5, wherein the first attribute is an RGB attribute having a set of pixel values corresponding to each one of a red color, a green color, and a blue color;

the second attribute is a xyY attribute having a set of a luminance value, a first chrominance value, and a second chrominance value;

the numerical space is an RGB space corresponding to the RGB attribute; and the other color space is a XYZ color space corresponding to an XYZ attribute.

7. The method of claim 5, wherein determining, in the numerical space, a polyhedron having a plurality of vertices and an enclosing diameter and determining, of the plurality of vertices, a plurality of sets of vertex values of the second attribute comprise:

determining the enclosing diameter of the polyhedron;

determining, of the plurality of vertices, a plurality of sets of vertex values of the first attribute based on respective set of start coordinates and the enclosing diameter; and measuring, of the plurality of vertices, the plurality of sets of vertex values of the second attribute corresponding to the plurality of sets of vertex values of the first attribute.

8. The method of claim 7, wherein determining, in the other color space, a distance between the respective set of target coordinates and each transformed face of the polyhedron comprises:

determining, in the other color space, an average distance between the respective set of target coordinates and a plurality of sub-faces formed by the transformed face.

9. The method of claim 8, wherein determining, in the numerical space, a set of new start coordinates based on a weighing of each of the plurality of vertices on the respective start point comprises:

determining, of each of the plurality of vertices, a plurality of sub-weighing each along a respective axis of the numerical space based on the distances between the respective set of target coordinates and transformed faces of the polyhedron along the respective axis;

determining, of each of the plurality of vertices, the weighing to be a product of the plurality of sub-weighing; and determining each component of the set of new start coordinates to be a sum of a corresponding component of each of the plurality of vertices in the numerical space weighed by the respective weighing of the vertices.

10. The method of claim 2, wherein determining the target first luminance value of the display panel comprises:

determining a plurality of white luminance values of the display panel, the plurality of white luminance values comprising a plurality of luminance values of the display panel displaying a plurality of white colors; and selecting one of the plurality of white luminance values that is closest to the target first luminance value; and determining, of the one of the plurality of white luminance values, a set of color values of the first attributes set to be the set of first start pixel values of the first attribute.

11. The method of claim 10, wherein determining the target first luminance value comprises determining a highest one of the plurality of white luminance values of the display panel; and determining a plurality of white luminance values of the display panel comprises determining a plurality of white luminance values corresponding to all greyscale values of the display panel.

12. The method of claim 1, wherein the second set of start pixel values of the first attribute is proportional to the second grayscale value and the first set of mapped pixel values;

the target second luminance value of the display panel is proportional to the first mapped luminance value and a target normalized luminance value corresponding to the second grayscale value, the target luminance calibration value being in the target luminance-grayscale correlation; and determining a first mapped luminance value comprises applying the first set of mapped pixel values on the display panel and measuring a luminance value of the display panel.

13. A method for determining a grayscale mapping correlation in a display panel, comprising:

determining a target luminance-grayscale mapping correlation and a set of target chrominance values of the display panel;

determining a target first luminance value of the display panel mapped to a first grayscale value;

determining a first set of start pixel values based on the first target first luminance value;

determining a first set of mapped pixel values of the first grayscale value and a first mapped luminance value based on the first set of start pixel values, the target first luminance value, and the set of target chrominance values;

determine a target second luminance value of the display panel mapped to a second grayscale value based on the second grayscale value and the first mapped luminance value, the second grayscale value being lower than the first grayscale value;

determining a second set of start pixel values based on the first set of mapped pixel values, the target luminance-grayscale correlation, and the set of target chrominance values; and determining a second set of mapped pixel values of the second grayscale value based on the second set of start pixel values, the target second luminance value, and the set of target chrominance values.

14. The method of claim 13, wherein determining a first set of mapped pixel values and determining a second set of mapped pixel values comprise:

determining a respective start point corresponding to the respective set of start pixel values in a numerical space;

determining a polyhedron having a plurality of vertices and an enclosing diameter in the numerical space, the polyhedron enclosing the respective start point;

determining a plurality of sets of vertex values each having a respective luminance value and a respective set of chrominance values;

converting the plurality of sets of vertex values into a plurality of sets of vertex coordinates in another color space, and the respective set of target value into a respective set of target coordinates in the other color space, the other color space being a three-dimensional color space;

determining, in the other color space, a distance between the respective set of target coordinates and each transformed face of the polyhedron, each transformed face being a transformation of a corresponding face of the polyhedron in the numerical space; and determining, in the numerical space, a set of new start coordinates based on a weighing of each of the plurality of vertices on the respective start point, the weighing being based on the distance between the respect set of target coordinates and each transformed face of the polyhedron.

15. The method of claim 14, further comprising:

determining whether the set of new start coordinates in the numerical space satisfies predetermined criteria; and determining the set of new start coordinates in the numerical space to be the respective set of mapped pixel values in response to the set of new start coordinates in the numerical space satisfying the predetermined criteria.

16. The method of claim 15, further comprising: in response to the set of new start coordinates in the numerical space not satisfying the predetermined criteria, determining the set of new start coordinates in the numerical space to be the respective set of start pixel values of the respective start point;

reducing the enclosing diameter of the polyhedron;

enclosing the respective start point with the polyhedron; and calculating the set of new start coordinates until the set of new start coordinates satisfies the predetermined criteria.

17. The method of claim 16, wherein determining whether the set of new start coordinates in the numerical space satisfies predetermined criteria comprises:

determining, of the new start coordinates, a set of new color values;

measuring, of each of the new start coordinates, a new luminance value and a new set of chrominance values corresponding to each of the set of new color values; and determining the new luminance value and the new set of chrominance values are each within a respective predetermined range, the numerical space is an RGB space corresponding to an RGB attribute; and the other color space is a XYZ color space corresponding to an XYZ attribute.

18. A system for determining a grayscale mapping correlation in a display panel, comprising:

a display having a plurality of pixel each comprising a plurality of subpixels; and a processor, comprising:

a graphics pipeline configured to generate a plurality of pixel values for the plurality of subpixels in each frame;

a pre-processing module configured to:

determine a target first luminance value of the display panel;

determine, of a first grayscale value, a first set of start pixel values of a first attribute based on the first grayscale value and the target first luminance value of the display panel;

determine, mapped to the first grayscale value, a first set of mapped pixel values of the first attribute and a first mapped luminance value based on the first set of start pixel values of the first attribute and a set of first target values of a second attribute, the set of first target values of the second attribute comprising a plurality of target chrominance values and the target first luminance value;

determine, of a second grayscale value, a second set of start pixel values of the first attribute based on the first set of mapped pixel values of the first attribute and a target luminance-grayscale correlation, the second grayscale value being less than the first grayscale value;

determine a target second luminance value of the display panel based on the second grayscale value, the first mapped luminance value and the target luminance-grayscale correlation; and determine, mapped to the second grayscale value, a second set of mapped pixel values of the first attribute based on the second start set of start pixel values of the first attribute, and a set of second target values comprising the plurality of target chrominance values and the target second luminance value: and a data transmitter configured to transmit the plurality of pixel values from the processor to the display in the frame.

19. The system of claim 18, wherein the pre-processing module is further configured to:

determine, in a numerical space corresponding to the first attribute, a respective start point having the respective set of start pixel values to be a respective set of start coordinates;

determine, in the numerical space, a polyhedron having a plurality of vertices and an enclosing diameter, the polyhedron enclosing the respective start point;

determine, of the plurality of vertices, a plurality of sets of vertex values of the second attribute, each of the plurality of sets of vertex values of the second attribute comprising a respective set of chrominance values and a respective luminance value;

convert the plurality of sets of vertex values of the second attribute into a plurality of sets of vertex coordinates of another color space, and the respective set of target values into a respective set of target coordinates of the other color space, the other color space being a three-dimensional color space;

determine, in the other color space, a distance between the respective set of target coordinates and each transformed face of the polyhedron, each transformed face being a transformation of a corresponding face of the polyhedron in the numerical space; and determine, in the numerical space, a set of new start coordinates based on a weighing of each of the plurality of vertices on the respective start point, the weighing being based on the distance between the respect set of target coordinates and each transformed face of the polyhedron.

20. The system of claim 19, wherein the pre-processing module is further configured to:

determine whether the set of new start coordinates in the numerical space satisfies predetermined criteria; and determine the set of new start coordinates in the numerical space to be the respective set of mapped pixel values in response to the set of new start coordinates in the numerical space satisfying the predetermined criteria.

* * * * *